US007138018B2

(12) United States Patent
Honkura et al.

(10) Patent No.: US 7,138,018 B2
(45) Date of Patent: Nov. 21, 2006

(54) PROCESS FOR PRODUCING ANISOTROPIC MAGNET POWDER

(75) Inventors: Yoshinobu Honkura, Tokai (JP); Norihiko Hamada, Tokai (JP); Chisato Mishima, Tokai (JP)

(73) Assignee: Aichi Steel Corporation, Aichi-ken (JP)

( * ) Notice: Subject to any disclaimer, the term of this patent is extended or adjusted under 35 U.S.C. 154(b) by 0 days.

(21) Appl. No.: 10/529,547

(22) PCT Filed: Jan. 15, 2004

(86) PCT No.: PCT/JP2004/000256

§ 371 (c)(1),
(2), (4) Date: Mar. 29, 2005

(87) PCT Pub. No.: WO2004/064085

PCT Pub. Date: Jul. 29, 2004

(65) Prior Publication Data

US 2006/0048855 A1 Mar. 9, 2006

(30) Foreign Application Priority Data

Jan. 16, 2003 (JP) ..... 2003-008805

(51) Int. Cl.
*H01F 1/04* (2006.01)
*H01F 1/57* (2006.01)

(52) U.S. Cl. ..... 148/122; 148/101; 148/105; 148/302

(58) Field of Classification Search ..... None
See application file for complete search history.

(56) References Cited

U.S. PATENT DOCUMENTS 4,851,058 A 7/1989 Croat (Continued)

FOREIGN PATENT DOCUMENTS

JP 2-4901 1/1990

(Continued)

OTHER PUBLICATIONS

C. Mishima et al.; Journal of the Magnetics Society of Japan, vol. 24, No. 4-2, 2000, pp. 407-410. English Abstract.

*Primary Examiner*—John P. Sheehan
(74) *Attorney, Agent, or Firm*—Westerman, Hattori, Daniels & Adrian, LLP.

(57) ABSTRACT

A method for manufacturing an anisotropic magnet powder includes a high-temperature hydrogenation process of holding an RFeB-based alloy containing rare earth elements (R), B and Fe as main ingredients in a treating atmosphere under a first treating pressure (P1) of which a hydrogen partial pressure ranges from 10 to 100 kPa and at a first treating temperature (T1) which ranges from 953 to 1133 K, a structure stabilization process of holding the RFeB-based alloy after the high-temperature hydrogenation process under a second treating pressure (P2) of which a hydrogen partial pressure is 10 or more and at a second treating temperature (T2) which ranges from 1033 to 1213 K such that the condition T2>T1 or P2>P1 is satisfied, a controlled evacuation process of holding the RFeB-based alloy after the structure stabilization process in a treating atmosphere under a third treating pressure (P3) of which a hydrogen partial pressure ranges from 0.1 to 10 kPa and at a third treating temperature (T3) which ranges from 1033 to 1213 K, and a forced evacuation process of removing residual hydrogen (H) from the RFeB-based alloy after the controlled evacuation process. With this method, the magnetic properties of the anisotropic magnet powder can be improved.

7 Claims, 9 Drawing Sheets

U.S. PATENT DOCUMENTS

| | | | | |
|---|---|---|---|---|
| 4,981,532 | A | 1/1991 | Takeshita et al. | |
| 5,110,374 | A * | 5/1992 | Takeshita et al. | 148/101 |
| 5,411,608 | A | 5/1995 | Hazelton et al. | |
| 5,851,312 | A * | 12/1998 | Honkura et al. | 148/122 |
| 6,444,052 | B1 * | 9/2002 | Honkura et al. | 148/122 |
| 6,955,729 | B1 * | 10/2005 | Honkura et al. | 148/302 |
| 2002/0059965 | A1 | 5/2002 | Honkura et al. | |
| 2003/0047240 | A1 * | 3/2003 | Honkura et al. | 148/105 |
| 2005/0067052 | A1 * | 3/2005 | Honkura et al. | 148/105 |

FOREIGN PATENT DOCUMENTS

| | | |
|---|---|---|
| JP | 5-163510 | 6/1993 |
| JP | 6-302412 | 10/1994 |
| JP | 11-31610 | 2/1999 |
| JP | 2000-21614 | 1/2000 |
| JP | 2001/076917 | 3/2001 |
| JP | P3250551 | 11/2001 |
| JP | 2002-43112 | 2/2002 |
| JP | 2002-93610 | 3/2002 |

* cited by examiner

PROCESS FOR PRODUCING ANISOTROPIC MAGNET POWDER

TECHNICAL FIELD

The present invention relates to a method for manufacturing an anisotropic magnet powder, which is capable of manufacturing an anisotropic magnet powder exhibiting excellent magnetic properties.

BACKGROUND ART

Magnets have been used in many machines and tools around us, such as various kinds of motors, and recently, the dimensions and weight of these machines and tools have been reduced, and the efficiency thereof has been enhanced. Accordingly, the development of permanent magnets exhibiting higher power has been demanded. To meet such demand, RFeB-based magnets (rare earth magnets), each being composed of rare earth elements (R), boron (B) and iron (Fe), have been developed. Examples of the methods for manufacturing such rare earth magnets include a melt-spinning method as one rapid-quenching method, which is disclosed in patent documents 1 and 2. And, as disclosed in patent documents 3 and 4, examples of such methods include HDDR (hydrogenation-disproportion-desorption-recombination) methods in which a hydrogenation·disproportionation reaction is carried out in two processes basically composed of a hydrogenation process and a dehydrogenation process. With these conventional methods, however, only magnet powder exhibiting low magnetic properties can be obtained. And these conventional methods are difficult to suit to the mass production of anisotropic magnet powder exhibiting excellent magnetic properties.

The present inventors have already developed a method for manufacturing anisotropic magnet powder exhibiting excellent magnetic properties, which is different from the above-described conventional methods. The properties of the magnet powder obtained with this method are unique, and accordingly, this method greatly differs from the HDDR method in processes thereof, whereby this method is called the d-HDDR method to distinguish it from the HDDR method. This d-HDDR method is characterized in that a plurality of processes using different temperatures and hydrogen pressures are provided, and that the reaction of the RFeB-based alloy and hydrogen is adjusted to a slow rate to obtain a homogeneous anisotropic magnet powder exhibiting excellent magnetic properties. More specifically, the d-HDDR method is basically composed of four processes consisting of a low-temperature hydrogenation process in which the RFeB-based alloy is made to absorb hydrogen sufficiently at room temperature, a high-temperature hydrogenation process in which a hydrogenation·disproportionation reaction is made under a low hydrogen pressure, a first evacuation process in which hydrogen is made to dissociate slowly under a hydrogen pressure as high as possible, and a second evacuation process in which hydrogen is removed from a resultant material. The details of each process are disclosed in patent documents 5 and 6, and non-patent document 1, etc.

Patent document 1: U.S. Pat. No. 4,851,058

Patent document 2: U.S. Pat. No. 5,411,608

Patent document 3: Publication of unexamined JP patent application No. Hei2-4901

Patent document 4: Publication of unexamined JP patent application No. Hei11-31610

Patent document 5: Japanese Patent No. 3250551

Patent document 6: Publication of unexamined JP patent application No. 2002-93610

Non-patent document 1: Transactions of the Magnetics Society of Japan, 24(2000), P. 407

DISCLOSURE OF INVENTION

With the above-described d-HDDR method, anisotropic magnet powder exhibiting excellent magnetic properties can be obtained, but magnets for use in driving motors of automobiles, etc. are required to exhibit higher magnetic properties. Furthermore, as the production increases, the amount of heat generated or absorbed in the reaction of the RFeB-based alloy and hydrogen increases so that the temperature in a treating atmosphere readily changes locally. Consequently, with this conventional method, the temperature change in the treating atmosphere cannot be adjusted properly so that the anisotropic magnet powder exhibiting high magnetic properties has been difficult to manufacture stably.

The present invention has been made considering these circumstances. Namely, the present invention has an object of providing a method for manufacturing an anisotropic magnet powder exhibiting excellent magnetic properties superior to those of conventional magnet powder. And the present invention has an object of providing a method for manufacturing an anisotropic magnet powder exhibiting high magnetic properties, which is capable of manufacturing the anisotropic magnet powder stably even when mass-produced.

To achieve these objects, the present inventors have earnestly studied, and as a result of repeated tries and errors, and repeated systematic experiments, they have reconsidered the conventional high-temperature hydrogenation process and controlled evacuation process, and newly found that an anisotropic magnet powder exhibiting excellent magnetic properties superior to those of the conventional magnet powder can be obtained by carrying out a structure stabilization process after the high-temperature hydrogenation process so as to raise at least one of the temperature and the hydrogen partial pressure thereof, and then carrying out the conventional controlled evacuation process. In addition, they have also confirmed that this new method is much suited to the mass production of such powder, and have completed the present invention.

The method for manufacturing an anisotropic magnet powder in accordance with the present invention includes a high-temperature hydrogenation process of holding an RFeB-based alloy which is composed of rare-earth elements (hereinafter referred to as "R") including yttrium (Y), boron (B) and iron (Fe) as main ingredients in a treating atmosphere under a first treating pressure (hereinafter referred to as "P1") of which a hydrogen partial pressure ranges from 10 to 100 kPa and at a first treating temperature (hereinafter referred to as "T1") which ranges from 953 to 1133 K, a structure stabilization process of holding the RFeB-based alloy subjected to the high-temperature hydrogenation process in a treating atmosphere under a second treating pressure (hereinafter referred to as "P2") of which a hydrogen partial pressure is 10 kPa or more and at a second treating temperature (hereinafter referred to as "T2") which ranges from 1033 to 1213 K such that the condition T2>T1 or P2>P1 is satisfied, a controlled evacuation process of holding the RFeB-based alloy subjected to the structure stabilization process in a treating atmosphere under a third treating pressure (hereinafter referred to as "P3") of which a hydrogen partial pressure ranges from 0.1 to 10 kPa and at a third treating temperature (hereinafter referred to as "T3") which ranges from 1033 to 1213 K, and a forced evacuation process of removing residual hydrogen (H) from the RFeB-based alloy after the controlled evacuation process.

The most different point of the method of the present invention from the conventional d-HDDR method is that the structure stabilization process is newly provided between the high-temperature hydrogenation process and the controlled evacuation process. The structure stabilization process has a great characteristic that at least one of the treating temperature and the hydrogen partial pressure thereof is increased, as compared with the high-temperature hydrogenation process.

By carrying out the structure stabilization process of increasing at least one of the temperature and the hydrogen partial pressure after the high-temperature hydrogenation process, and further carrying out the controlled evacuation process, magnet powder exhibiting excellent magnetic properties as compared with the conventional magnet powder can be obtained. In addition, it has been also found that with this manufacturing method, the anisotropic magnet powder exhibiting high magnetic properties can be mass-produced stably.

It has not been sufficiently clarified why the manufacturing method in accordance with the present invention exhibits such excellent effects, but at present, it can be considered, as follows.

The conventional d-HDDR method is basically composed of the following four steps:

① In a low-temperature hydrogenation process, hydrogen is made to be sufficiently solved in a solid phase by applying a hydrogen pressure in a temperature range not more than the hydrogenation·disproportionation reaction temperature so that the hydrogenation·disproportionation reaction slowly proceeds in the next process (high-temperature hydrogenation process).

② Then, in a high-temperature hydrogenation process, the hydrogenation·disproportionation reaction is made to proceed while absorbing hydrogen at a predetermined temperature and under a predetermined pressure.

③ Then, in a controlled evacuation process, the recombination reaction is made to proceed slowly by carrying out dehydrogenation slowly at the same temperature as that in the high-temperature hydrogenation process and under a predetermined comparatively high pressure.

④ Furthermore, in a forced evacuation process, dehydrogenation is carried out to remove residual hydrogen, thereby completing the treatments, three phase decomposition is made to proceed as slowly as possible, and recombination is made to proceed as slowly as possible.

To develop the method for manufacturing magnet powder having excellent magnetic properties superior to those of the conventional magnet powder, the present inventors have earnestly studied the relation between the above-described various treatments and structure, and have reexamined the conventional d-HDDR method.

In the conventional high-temperature hydrogenation process, the hydrogenation·disproportionation reaction has been made to proceed as slowly as possible. However, this results in the hydrogenation·disproportionation reaction being not completed sufficiently so that a small amount of 2-14-1 phase ($R_2Fe_{14}B$ phase) remains, and deposit to be hydrogenated and decomposed remains. As a result, it has been considered that the expected magnetic properties have not been sufficiently exhibited. If the hydrogenation·disproportionation reaction is not finished completely, homogeneous crystal grains are difficult to obtain after the recombination reaction. As a result, the magnet powder becomes a grain-mixed structure, for example, thereby lowering the iHc, the rectangular properties of the magnetic curve, and (BH) max.

In general, the reaction rate of the chemical reaction is highest at the beginning thereof, and gradually slows down. Therefore, it has been said that the reaction has not been completed if not held for a long period of time. Namely, as the reaction approaches an end thereof, the reaction is difficult to proceed. Where the period of time of the high-temperature hydrogenation process is simply extended in anticipation of the slowdown of the reaction rate in order to complete the hydrogenation·disproportionation reaction, the hydrogenation·disproportionation reaction is completed, but the heat treating time becomes too long, thereby causing the deterioration of the structure (coarsening of structure, etc.) and the lowering of the magnetic properties.

The present inventors have got the following idea for completing the hydrogenation·disproportionation reaction sufficiently without coarsening of structure. Namely, at the beginning where the reaction speed is relatively high, the hydrogenation·disproportionation reaction is made to proceed as slowly as possible, but, in this case, the reaction rate gradually slows down so that a long period of time is needed to complete the reaction. Accordingly, the present inventors have contemplated that it is effective to increase the reaction rate of the hydrogenation·disproportionation reaction, thereby completing the above-described reaction speedily.

The hydrogenation·disproportionation reaction is a unique reaction which is controlled with both the temperature and hydrogen partial pressure. The present inventors have investigated the means of increasing the reaction rate by controlling the treating temperature and hydrogen partial pressure. Namely, it has been considered that by increasing the treating temperature, the driving force for the hydrogenation·disproportionation reaction increases to enable the speedy completion of the reaction. In addition, it has been considered that by increasing the hydrogen partial pressure, the reaction is speedily completed like the case in which the treating temperature is increased.

For the above-described reason, by increasing at least one of the hydrogen pressure and the treating temperature at the end of the hydrogenation·disproportionation reaction, such reaction can be completed speedily.

The present invention has solved the above-described problem by newly providing the structure stabilization process between the high-temperature hydrogenation process and the controlled evacuation process. Consequently, it has also become possible to enlarge the treating temperature ranges in the conventional high-temperature hydrogenation process and controlled evacuation process independently. For example, in the case of the conventional d-HDDR treatment, the treating temperature range in the high-temperature hydrogenation process and the controlled evacuation process was as narrow as from 1033 to 1133 K. In contrast, in the case of the present invention, the treating temperature range of the high-temperature hydrogenation process can be enlarged to the range from 953 to 1133 K and the treating temperature range of the controlled evacuation process can be enlarged to the range from 1033 to 1213K. Thus, the treating temperature range of each process can be enlarged to approximately double the conventional treating temperature range.

As a result, even where a rapid heat generation occurs in the high-temperature hydrogenation process, and a rapid heat absorption occurs in the controlled evacuation process due to the increment of the treating amount, each process can be carried out in a proper temperature range. More specifically, by carrying out the high-temperature hydrogenation process at temperatures on the lower temperature side of the above-described proper temperature range, and carrying out the controlled evacuation process at temperatures on the higher temperature side of the above-described proper temperature range, each process can be treated in the proper temperature range even when the treating amount is increased. In addition, the treating temperature range of each process can be enlarged so that the temperature adjustment of each process is much facilitated.

As described above, even where the treating amount is increased, the high-temperature hydrogenation process proceeds in the temperature range suited to the hydrogenation·disproportionation reaction, and the controlled evacuation process proceeds stably in the temperature range suited to the recombination reaction. As a result, anisotropic magnet powder exhibiting high magnetic properties such as excellent Br and iHc, and accordingly excellent (BH)max can be stably obtained when mass-produced.

Figure 1:
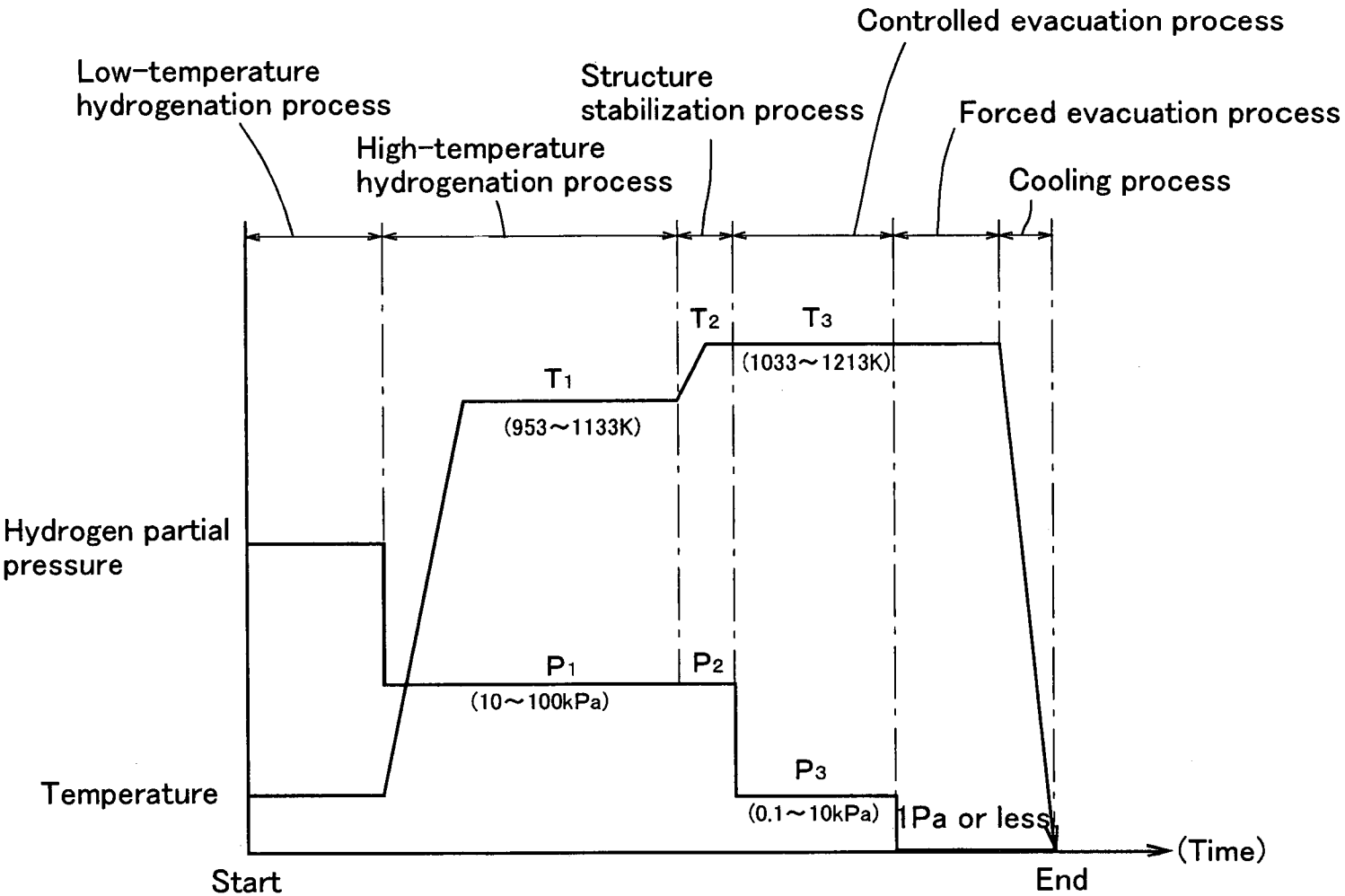
FIG. 1 is a first process pattern diagram which diagrammatically shows details of treatments in each process.

BEST MODE FOR CARRYING OUT THE INVENTION (Embodiment)

Hereinafter, the present invention will be explained with reference to embodiments.

(1) RFeB-Based Alloy

RFeB-based alloy is composed of rare earth elements (R) including Y, B and Fe as main ingredients. Representative examples of the RFeB-based alloy include an ingot of which a main phase is $R_2Fe_{14}B$, coarse powder or fine powder which is obtained by pulverizing the ingot.

R is rare earth elements including Y, but is not limited to one kind of element. A plurality of rare earth elements may be combined with each other, or one part of a main element may be replaced with another element.

Such R is composed of scandium (Sc), yttrium (Y), and lanthanoid. It is preferable that R as elements exhibiting excellent magnetic properties is composed of at least one element selected from the group consisting of Y, lanthanum (La), cerium (Ce), praseodymium (Pr), neodymium (Nd), samarium (Sm), gadolinium (Gd), terbium (Tb), dysprosium (Dy), holmium (Ho), erubium (Er), trium (TM) and lutetium (Lu). In particular, it is preferable that R is composed of at least one of Pr, Nd and Dy from the viewpoints of the cost and magnetic properties.

And, it is preferable that the RFeB-based alloy contains iron as a main ingredient, and further contains 11 to 16 at % of R and 5.5 to 15 at % of B where the total amount of the RFeB-based alloy is 100 atomic % (at %), because where R is less than 11 at %, the a Fe phase deposits to lower the magnetic properties, where R exceeds 16 at %, the $R_2Fe_{14}B$ phase decreases to lower the magnetic properties, where B is less than 5.5 at %, the $R_2Fe_{17}$ phase exhibiting soft magnetic properties deposits to lower the magnetic properties, and where B exceeds 15 at %, the $R_2Fe_{14}B$ phase decreases to lower the magnetic properties. Where the B content increases to 10.8 at % or more, the deposition of proeutectic α-Fe is restrained, thereby restraining the deposition of α-Fe, which causes the lowering in magnetic properties, whereby the disproportionation heat treating process which has been conventionally considered essential to the improvement of the magnetic properties can be omitted. As a result, the cost of magnet powder, etc. can be further decreased.

And, it is preferable that the RFeB-based alloy further contains at least one of gallium (Ga) and niobium (Nb), and it is more preferable that it contains both of them. Ga is an element which is effective in improving the coercive force iHC of the anisotropic magnet powder. It is preferable that the RFeB-based alloy contains 0.01 to 2 at % of Ga where the total amount of the RFeB-based alloy is 100 at %. And it is more preferable that the RFeB-based alloy contains 0.1 to 0.6 at % of Ga. In the case of less than 0.01 at %, sufficient effect cannot be obtained, and in the case of greater than 2 at %, the iHC conversely decreases.

Nb is an element effective in improving the residual magnetic flux density Br. It is preferable that where the total amount of RFeB-based alloy is 100 at %, the RFeB-based alloy contains 0.01 to 1 at % of Nb. And it is more preferable that the RFeB-based alloy contains 0.1 to 0.4 at % of Nb. In the case of less than 0.01 at %, sufficient effect cannot be obtained, and in the case of greater than 1 at %, the hydrogenation·disproportionation reaction in the high-temperature hydrogenation process slows down. When Ga and Nb are added in combination, both the iHc and the anisotropy rate of the anisotropic magnet powder can be improved, thereby increasing the maximum energy product (BH)max.

The RFeB-based alloy may contain Co. Co is an element effective in raising the curie point of the anisotropic magnet powder and improving the heat resistance thereof. It is preferable that where the total amount of RFeB-based alloy is 100 at %, the RFeB-based alloy contains 0.1 to 20 at % of Co. And it is more preferable that the RFeB-based alloy contains 1 to 6 at % of Co. Where the Co content is too small, its effect is not achieved, but since Co is expensive, if the Co content increases, the cost thereof increases so as to be less preferable.

In addition, the RFeB-based alloy may contain at least one element selected from the group consisting of Ti, V, Zr, Ni, Cu, Al, Si, Cr, Mn, Zn, Mo, Hf, W, Ta and Sn. These elements are effective in improving the coercive force and shaping the magnetizing curve into a rectangular curve, and it is preferable that the total amount of these elements is not more than 3 at % where the total amount of RFeB-based alloy is 100 at %. When the total amount of these elements is too small, the desired effect is not achieved, but when it is too great, deposit phase or the like appears to cause the lowering in the coercive force, or the like.

It is preferable that the RFeB-based alloy further contains 0.001 to 1.0 at % of La in addition to R. As a result, the anisotropic magnet powder and resultant hard magnet such as bonded magnet can be restrained from deteriorating with the years. The reason for this result is that La is the element having the greatest oxidation potential among rare earth elements (R. E.). Consequently, La operates as a so-called oxygen getter, and is oxidized selectively as compared with the above-described R such as Nd, Dy or the like (with priority thereto) to restrain the oxidation of the magnet powder and the hard magnet, each containing La. It can be considered to use Dy, Tb, Nd, Pr, etc. in place of La, but La is more preferable from the viewpoint of the oxidation restraining effect and cost. Where La is made to be contained for such intention, other rare earth elements than La should be selected as R in the RFeB-based alloy.

The effect of La, that is the improvement of corrosion resistance, can be obtained with the addition of a very small amount of La, which exceeds the level amount of inevitable impurities. When the level amount of the inevitable impurities is less than 0.001 at %, the lower limit of the La content may be 0.001 at %, 0.01 at %, 0.05 at % or 0.1 at %. On the other hand, when La exceeds 1.0 at %, the iHc lowers so as to be less preferable. Accordingly, it is more preferable that the La content ranges from 0.01 to 0.7 at %. Of course, the RFeB-based alloy contain inevitable impurities, and the composition thereof is balanced with Fe.

The RFeB-based alloy can be manufactured by using an ingot which is melted and cast by various melting methods (high frequency melting method, arc melting method or the like) or a raw material which is prepared by the strip casting method. And where the RFeB-based alloy is powder obtained by pulverizing the ingot, strip or the like, the d-HDDR treatment proceeds at a constant rate so as to be preferable. When pulverizing, a generally used hydrogen pulverization method, mechanical pulverization method, or the like can be used.

(2) d-HDDR Treatment

The manufacturing method in accordance with the present invention includes four essential processes of the high-temperature hydrogenation process, structure stabilization process, controlled evacuation process and forced evacuation process. But, these processes need not be carried out sequentially. In addition, where the manufacturing method of the present invention further includes a low-temperature hydrogenation process before the high-temperature hydrogenation process, and a cooling process after the controlled evacuation process, it is preferable considering the mass production properties, too. And in order to improve the magnetic properties of the anisotropic magnet powder and improve the heat resistance, corrosion resistance or the like of the hard magnet (bonded magnet or the like) formed of the anisotropic magnet powder, thereby enlarging the uses thereof, it is preferable to carry out a diffusion heat treatment process, etc. Hereinafter, these processes will be explained.

① Low-Temperature Hydrogenation Process

The low-temperature hydrogenation process is the process of holding the RFeB-based alloy in a hydrogen atmosphere of which the temperature is not higher than 873 K, more preferably not higher than 723 K, before the high-temperature hydrogenation process. With this process, the the RFeB-based alloy is made to previously occlude a sufficient amount of hydrogen in such a low-temperature range as not to cause the hydrogenation·disproportionation reaction, thereby readily controlling the reaction rate of the hydrogenation·disproportionation reaction in the high-temperature hydrogenation process. When the treating amount is small, the occlusion of hydrogen in the RFeB-based alloy can be carried out in the high-temperature hydrogenation process, and accordingly, in the manufacturing method of the present invention, this process is not essential. Of course, it is preferable to provide this process for treating a large amount of RFeB-based alloy, and consequently mass-producing anisotropic magnet powder which exhibits high magnetic properties stably.

Since this process is carried out in such a temperature range as not to produce hydrogenation·disproportionation reaction, it can be considered that the following reaction mainly proceeds.

$$R_2Fe_{14}B_1 \rightarrow R_2Fe_{14}B_1\ Hx$$

Namely, hydrogen is merely included between lattices of the RFeB-based alloy or crystal grain boundaries, and accordingly, in this process, the phase transformation is not basically generated.

The starting temperature of the hydrogenation·disproportionation reaction depends on the composition of the raw alloys, but, normally, ranges from 873 to 1033 K. By determining the temperature of the present process at higher than 873 K, the structure transformation locally occurs to make the structure inhomogeneous. This causes the magnetic properties of the anisotropic magnet powder to remarkably lower so as to be less preferable. For this reason, it is preferable that the present process is carried out in the temperature range which is not higher than 873 K, and more preferably in the temperature range which is not higher than 723 K, and most preferably in the temperature range from room temperature to about 573 K. The hydrogen pressure (partial pressure) in the low-temperature hydrogenation process is not limited specifically, but it is preferable to determine it to the range from 30 to 100 kPa, ex. By determining the hydrogen pressure to 30 kPa or more, the time for occluding hydrogen in the RFeB-based alloy can be shortened, and by determining the hydrogen pressure to 100 kPa or less, the hydrogen occlusion can be carried out economically. The treatment atmosphere is not limited to hydrogen gas. A mixture of hydrogen gas and inert gas, ex. will do. The important factor in this process is hydrogen partial pressure, and this is true in the following processes, too.

② High-Temperature Hydrogenation Process

The high-temperature hydrogenation process is the process of holding the RFeB-based alloy in a treatment atmosphere of which the hydrogen partial pressure ranges from 10 to 100 kPa, and the temperature is a first treatment temperature (T1) ranging from 953 to 1133 K. The structure of the RFeB-based alloy which has occluded hydrogen in the present process is decomposed into three phases (Fe phase, $RH_2$ phase, $Fe_2B$ phase) in the present process. It can be considered that the following hydrogenation·disproportionation reaction mainly proceeds in the present process.

$$R_2Fe_{14}B_1Hx \rightarrow RH_2+Fe(B) \rightarrow RH_2+Fe+Fe_2B$$

Namely, first, the RFeB-based alloy occluding hydrogen is decomposed to Fe and hydride of R ($RH_2$), thereby forming a layered lamellar structure. This Fe is considered to be in the state where B is dissolved in a solid phase in a supersaturated condition. And it can be considered that in this lamellar structure, distortion is introduced in only one direction, and that B dissolved in a solid phase in a supersaturated condition deposits as tetragonal $Fe_2B$ in one direction along the above-described distortion.

Where the reaction rate is great, the lamellar structure in which distortion is oriented in one direction is not formed, and the directions of the deposited $Fe_2B$ also become random. Namely, the anisotropy rate lowers to decrease Br. Accordingly, to obtain the anisotropic magnet powder having high magnetic properties, it is preferable to make the above-described reaction proceed as slowly as possible. To make the reaction rate slow, the upper limit of the hydrogen partial pressure is limited to 100 kPa in the present process. But, when the hydrogen partial pressure is too small, the above-described reaction does not occur, or a large amount of untransformed structure remains, thereby causing the lowering of the coercive force so as to be less preferable. Therefore, the lower limit thereof is determined to 10 kPa.

And when the treatment temperature in the present process is lower than 953 K, the above-described reaction does not proceed, and when the treatment temperature exceeds 1133 K, $Fe_2B$ is difficult to deposit from the supersaturated Fe in one direction, or the above-described lamellar structure is difficult to form, because the reaction rate is high. As a result, Br in the magnet powder is caused to be lowered. Accordingly, the present process has been determined to be carried out at a first determining temperature (T1) ranging from 953 to 1133 K, at which the above-described reaction proceeds slowly. The details of the preferable reaction rate or the like are also disclosed in the above-described patent document 5 and non patent document 1.

③ Structure Stabilization Process

The structure stabilization process is the process of raising the reaction rate at the end of the high-temperature hydrogenation process to complete the reaction sufficiently, thereby effecting the three-phase decomposition surely. Accordingly, in the structure stabilization process, such a treatment atmosphere as to raise the reaction rate at the end of the high-temperature hydrogenation process may be formed by arbitrarily selecting the treatment temperature (T2) or the hydrogen partial pressure (P2). More specifically, as compared with the treatment temperature (T1) and the hydrogen partial pressure (P1) in the high-temperature hydrogenation process, at least the condition of T2>T1 or P2>P1 may be satisfied. The increment of P2 and T2 in the structure stabilization process as compared with P1 and T1 in the high-temperature hydrogenation process is not the object of the present process, but the improvement of the reaction rate at the end of the high-temperature hydrogenation process is the object of the present process. Accordingly, provided that the reaction rate at the end of the high-temperature hydrogenation process increases, the condition of T2>T1 and P2<P1 or the condition of T2<T1 and P2>P1 will do. Even if P2 is determined to 20 kPa, when P1 is 30 kPa, for example, by raising T2 higher than T1 such that the influence of the condition of P2<P1 is sufficiently overcome, the object of the structure stabilization process is sufficiently attained. On the other hand, even if T2 is determined to 1048 K, when T1 is 1073 K, for example, by increasing P2 higher than P1 such that the influence of the condition of T2<T1 is sufficiently overcome, the object of the structure stabilization process is sufficiently attained.

Of course, in order to shift the high-temperature hydrogenation process to the structure stabilization process smoothly, and obtain magnet powder exhibiting high magnetic properties stably, it is more preferable that the treatment atmosphere of the structure stabilization process satisfies the condition of T2>T1 and P2>P1 or the condition of P2>P1 and T2≧T1. Namely, this condition means that at least one of the treatment temperature and the hydrogen partial pressure in the structure stabilization process is higher than those in the high-temperature hydrogenation process. This condition enables the further promotion of the hydrogenation·disproportionation reaction which has proceeded and the reaction rate has lowered. And the residual 2-14-1 phase and the deposit to be hydrocracked after the high-temperature hydrogenation process are speedily hydrocracked.

The hydrocracking may be completed during the raising of the temperature and increasing of the pressure. In any case, it is preferable to continue the structure stabilization process until the hydrocracking is finished approximately completely.

The structure stabilization process is carried out to hydrocrack the residual 2-14-1 phase and the deposit to be hydrocracked after the high-temperature hydrogenation process. Considering this point, the range of the hydrogen partial pressure P2 was determined to 10 kPa or more, and the range of the treatment temperature T2 was determined to 1033 to 1213 K.

When the hydrogen partial pressure is less than 10 kPa, the recombination starts and consequently, the magnetic properties lowers. On the other hand, the upper limit of the hydrogen partial pressure is not limited. As P2 increases, the effect of the structure stabilization process tends to be enhanced. But, considering the production convenience such as the cost, durability, etc. of a treatment furnace, the preferred upper limit of P2 is 200 kPa.

The reason why the treatment temperature is determined to the range from 1033 to 1213 K is that in the case of not more than 1033 K, the hydrocracking of the residual 2-14-1 phase and the deposit to be hydrocracked does not proceed to cause the lowering of the magnetic properties, and in the case of not less than 1213 K, the deterioration of the structure occurs to cause the lowering of the magnetic properties.

④ Controlled Evacuation Process

The controlled evacuation process is the process of holding the RFeB-based alloy after the structure stabilization process in a treatment atmosphere of which the hydrogen partial pressure is a third treatment pressure (P3) ranging from 0.1 to 10 kPa, and the temperature is a third treatment temperature (T3) ranging from 1033 to 1213 K.

In the present process, hydrogen is removed from $RH_2$ phase in the three phases formed in the preceding high-temperature hydrogenation process, and $R_2Fe_{14}B_1$ phase which contains $Fe_2$ B as a core and of which the crystal orientation is equally arranged, is recombined. At this time, it is considered that the following recombination reaction mainly proceeds.

$$RH_2+Fe+Fe_2B \rightarrow R_2Fe_{14}B_1Hx+H_2$$

It is preferable that this recombination reaction proceeds as slowly as possible. Where the reaction rate is high, the orientation of the crystal of which the core is $Fe_2B$ is distorted to lower the anisotropy of the recombined $R_2$ $Fe_{14}B$, phase and decrease the magnetic properties thereof.

Accordingly, in the present process, the third treatment pressure (P3) was determined to the range from 0.1 to 10 kPa. If a rapid evacuation of which the hydrogen partial pressure is less than 0.1 kPa is carried out, the evacuation rate of the alloy material in the vicinity of an evacuation outlet differs from that of the alloy material distant from the evacuation outlet, whereby the recombination reaction rate may become unequal. And, since the recombination reaction is an endothermic reaction, the temperature becomes unequal with positions, and accordingly the magnetic properties of the entire anisotropic magnet powder lower. On the other hand, when the hydrogen partial pressure exceeds 10 kPa, the recombination reaction does not proceed, whereby the reverse structure transformation becomes insufficient, and accordingly, the anisotropic magnet powder of which the iHc is high cannot be obtained.

And, when the treatment temperature in the present process is less than 1033 K, the above-described reaction does not proceed. On the other hand, when the treatment temperature exceeds 1213 K, the recombination reaction does not proceed properly, and consequently, the crystal grains become large. As a result, the anisotropic magnet powder of which the iHc is high cannot be obtained. Accordingly, it has been decided to carry out the present process at the third treatment temperature (T3) ranging from 1033 to 1213 k, at which the above reaction slowly proceeds. The details of the preferable reaction rate or the like in the present process are also disclosed in the above-described patent document 5 and non-patent document 1.

⑤ Forced Evacuation Process

The forced evacuation process is the process of removing hydrogen (residual hydrogen) from the RFeB-based alloy after the controlled evacuation process. In the present process, it is considered that the following reaction mainly proceeds.

$$R_2Fe_{14}B_1Hx \rightarrow R_2Fe_{14}B_1 + xH_2$$

The treatment temperature, the degree of vacuum, etc. in the present process are not limited specifically. It is preferable to draw gases to the degree of vacuum of about 1 Pa or less at a temperature approximately equal to the above-described T3 or lower than T3, because, if the degree of vacuum is low, the hydrogen may remain to cause the lowering of the magnetic properties. If the treatment temperature is too low, it takes a long time to evacuate gases, and if the treatment temperature is too high, the crystal grains become large, which is less preferable.

This forced evacuation process does not need to be carried out continuously with the above-described controlled evacuation process. A cooling process of cooling the alloy material may be provided between the controlled evacuation process and the present process. The cooling process is effective where the RFeB-based alloy obtained after the controlled evacuation process is transferred to another treatment furnace or the like for batch treating the forced evacuation process or the like upon mass production, or the like. Upon pulverizing the RFeB-based alloy to a predetermined grain size, it is convenient to provide the cooling process. In addition, when the later-describing diffusion heat treatment is carried out, this cooling process facilitates the mixing of the RFeB-based alloy ($R_2Fe_{14}B_1$ Hx) with a diffusion material. It may be considered that this diffusion heat treatment process serves as the forced evacuation process of the present invention, too. Namely, it may be considered that one embodiment of the forced evacuation process is the diffusion heat treatment process.

The cooling condition of the RFeB-based alloy in the cooling process is not important. The cooling process is carried out to facilitate the handling of the RFeB-based alloy. Therefore, any cooling temperature, cooling method, cooling atmosphere or the like will do. In addition, since hydrides exhibit oxidation resistance, the RFeB-based alloy thereof can be taken in the air at room temperature. Of course, it is preferable to carry out the forced evacuation process of raising the temperature of the RFeB-based alloy ($R_2Fe_{14}B_1Hx$) again and drawing gases therefrom, etc. after the cooling process.

And where the RFeB-based alloy ($R_2Fe_{14}B_1Hx$) is mixed with the diffusion material after the controlled evacuation process, and then the diffusion heat treatment process is carried out, it is efficient to carry out the forced evacuation process together after the diffusion heat treatment process.

(3) Diffusion Heat Treatment

The anisotropic magnet powder exhibiting sufficiently high magnetic properties can be obtained only with the above-described d-HDDR treatment. But, by carrying out the later-describing diffusion heat treatment, the anisotropic magnet powder exhibiting improved coercive force and corrosion resistance can be-obtained.

This diffusion heat treatment basically includes a mixing process of mixing the RFeB-based alloy ($R_2Fe_{14}B_1Hx$) after the controlled evacuation process or the RFeB-based alloy (anisotropic magnet powder) after the forced evacuation process with a diffusion material such as Dy, etc. to prepare a mixture powder, and a diffusion heat treatment process of heating the mixture powder to make Dy, etc. diffuse on a surface or into an inside of the RFeB-based alloy.

① Diffusion Material

The diffusion material may be the material containing at least one of the elements (hereinafter referred to as "R1") of dysprosium (Dy), terbium (Tb), neodymium (Nd), praseodymium (Pr) and lanthanum (La). For example, it may contain at least one of a simple substance, alloy, chemical compound or hydride (R1 material) of the elements (R1) of Dy, Tb, Nd, Pr and La. Examples of the hydride include hydride of the single substance, alloy or chemical compound of R1. In addition, a mixture of these materials will do. The configuration of the diffusion material before the mixing process is not limited specifically, but such a configuration as to be readily formed into a mixture powder in the mixing process is preferable. Accordingly. It is preferable to use a powdery diffusion material (diffusion powder) as required, and in this case, homogeneous diffusion of R1 into the RFeB-based alloy is facilitated.

It is more preferable that the R1 material contains at least one kind of transition elements (hereinafter referred to as "TM") selected from the 3d transition elements and 4d transition elements, and that TM homogeneously diffuse on the surface and into the inside of the RFeB-based alloy along with R1 in the diffusion heat treatment process. With this method, further improvement of the coercive force and further lowering of the permanent demagnetizing factor can be achieved. The 3d transition elements have atomic numbers ranging from 21 (Sc) to 29 (Cu), and 4d transition elements have atomic numbers ranging from 39 (Y) to 47 (Ag). In particular, Fe, Co, Ni of group 8 is effective in improving the magnetic properties. In addition, the diffusion material may be a mixture which is obtained by separately preparing a powder of R1 material, and a powder of a single substance, alloy, chemical compound or hydride of TM (TM material), and mixing these materials. The chemical compounds in the present specification include intermetallic compounds, too. And the hydrides include the hydride containing hydrogen in a solid phase, too.

Examples of these diffusion materials include dysprosium powder, dysprosium cobalt powder, dysprosium iron powder, dysprosium hydride powder, dysprosium cobalt hydride powder, and dysprosium iron hydride powder. In particular, in the case of R1 being Dy, the coercive force of the anisotropic magnet powder is improved, and in the case of TM being Co, the Curie point of the anisotropic magnet powder is raised. In the case of Fe being contained in TM, the cost can be lowered.

In particular, where the diffusion material is composed of a diffusion powder of which the average particle diameter ranges from 0.1 to 500 μm, the diffusion of R1 is readily carried out so as to be preferable. The diffusion material of which the average particle diameter is less than 0.1 μm is difficult to produce, and when the average particle diameter exceeds 500 μm, homogeneously mixing of the diffusion powder with the RFeB-based alloy becomes difficult. And it is more preferable that the average particle diameter ranges from 1 to 50 μm.

Such diffusion powder is obtained by subjecting the R1 material to well-known hydrogen pulverization, dry-type or wet-type mechanical pulverization (jaw crusher, disc mill, ball mill, vibration mill, jet mill, etc.) or the like. The hydrogen pulverization is efficient for pulverizing the R1 material. It is preferable to use hydride powder as the diffusion powder from this viewpoint. Furthermore, it is more preferable to carry out the dry-type or wet-type mechanical pulverization after the hydrogen pulverization.

② RFeB-Based Alloy Prior to the Diffusion Heat Treatment

It is efficient to use the RFeB-based alloy obtained after the controlled evacuation process or after the forced evacuation process as the RFeB-based alloy to be mixed with the diffusion material, and it is also preferable for improving the magnetic properties of the anisotropic magnet powder. Where the RFeB-based alloy ($R_2Fe_{14}B_1Hx$) obtained after the controlled evacuation process is used, it is preferable to carry out the dehydrogenation process before the diffusion heat treatment process, or carry out the diffusion heat treatment process which serves as the forced evacuation process, too. Namely, the above-described mixing process is the process of mixing the hydride powder of RFeB-based alloy which is obtained after the controlled evacuation process with the diffusion powder of the hydride powder containing R1, and the above-described diffusion heat treatment process may be the process which also serves as the forced evacuation process of removing residual oxygen from the mixture powder.

And, the configuration of the RFeB-based alloy is not limited specifically, but it is preferable that the average grain size is not more than 200 μm, considering the mixing properties and diffusion properties with the diffusion material.

③ Mixing Process

The mixing process is the process of mixing the RFeB-based alloy and the diffusion material with each other to prepare a mixture powder. In the mixing process, a henschel mixer, rocking mixer, ball mill or the like can be used. And it is especially preferable to use a rotary kiln or rotary retort, each being the furnace used for the diffusion heat treatment process, which additionally has a mixing function. To homogeneously mix the RFeB-based alloy with the diffusion material, it is preferable to properly carry out the pulverization and classification of the raw materials. By carrying out the classification, the formation of the bonded magnet or the like is facilitated. And to prevent oxidation of the anisotropic magnet powder, It is preferable to carry out the mixing process in an oxidation preventing atmosphere (such as an inert gas atmosphere and vacuum atmosphere).

Upon mixing the diffusion material, it is preferable to mix 0.1 to 3.0 mass % of the diffusion material where the entire mixture powder is 100 mass %. By properly adjusting the mixing ratio of the diffusion material, the anisotropic magnet power exhibiting high magnetic properties such as excellent coercive force, excellent residual magnetic flux density and excellent rectangular properties of magnetic curve, and exhibiting excellent permanent demagnetizing factor can be obtained.

④ Dehydrogenation Process

The dehydrogenation process is the process of removing residual hydrogen from the mixture powder. Where at least one of the RFeB-based alloy and the diffusion material is hydride, the dehydrogenation process is needed before the diffusion heat treatment process, or the dehydrogenation process which also serves as the diffusion heat treatment process is needed to contain hydrogen of the hydride.

Where the RFeB-based alloy before the forced evacuation process is mixed with the diffusion material, and subjected to the diffusion heat treatment, the present process also serves as the forced evacuation process of the d-HDDR treatment. Where the RFeB-based alloy after the forced evacuation process is mixed with the diffusion material composed of hydride, and subjected to the diffusion heat treatment, the dehydrogenation process needs to be carried out before the diffusion heat treatment process. In this case, the dehydrogenation process may be carried out in a vacuum atmosphere which is not more than 1 Pa, and ranges from 1023 to 1123 K, for example. The reason why the pressure is determined to not more than 1 Pa is that when the pressure exceeds 1 Pa, hydrogen remains to cause the lowering of the coercive force of the anisotropic magnet powder. The reason why the temperature is determined to the range of 1023 to 1123 K is that when the temperature is less than 1023 K, the removing rate of the residual hydrogen is low, whereas when the temperature exceeds 1123 K, the crystal grain becomes large.

⑤ Diffusion Heat Treatment Process

The diffusion heat treatment process is the process of heating the mixture powder obtained after the mixing process to make R1 as the diffusion material diffuse on a surface and into an inside of the RFeB-based alloy.

R1 acts as an oxygen getter, too, and restrains the oxidation of the anisotropic magnet powder and hard magnet which uses the anisotropic magnet powder. Therefore, even where the magnet is used in a high-temperature environment, degradation of properties caused by oxidation can be effectively restrained and prevented. And since the heat resistance of the magnet powder is improved, the use thereof is enlarged.

It is preferable that this diffusion heat treatment process is carried out in an oxidation preventing atmosphere (vacuum atmosphere, for example), and the preferred temperature ranges from 673 to 1173 K, and the more preferred temperature is not more than the temperature of the controlled evacuation process (T3). In the case of less than 673 K, the diffusion rates of R1 and TM are slow so as to be not efficient, whereas in the case of greater than 1173 K and T3, the crystal grain becomes large and is less preferable. In addition, in order to prevent the growth of the crystal grain, it is preferable to cool it rapidly.

(4) Others

The anisotropic magnet powder obtained with the manufacturing method of the present invention is formed into sintered magnets and bonded magnets, each having a desired configuration. In particular, the anisotropic magnet powder obtained with the manufacturing method of the present invention can be freely formed into a desired configuration so as to be effective in forming the bonded magnets which do not require high-temperature heating. The bonded magnet is manufactured by adding a thermosetting resin, thermoplastic resin, coupling agent or lubricant, etc. to the obtained anisotropic magnet powder, kneading an obtained mixture and subjecting the kneaded mixture to compression molding, extruding, injection molding, or the like in a magnetic field.

EXAMPLES

Hereinafter, the present invention will be explained based on examples thereof.

(Production of Test Pieces)

(1) First Example

To examine the effect of the d-HDDR treatment in accordance with the present invention, test pieces No. 1 through 26 and No. C1 through C24 shown in Tables 1 and 2 were manufactured. Four kinds of RFeB-based alloys having different compositions were prepared as raw materials for manufacturing these test pieces. These compositions are shown in Table 3. The unit used in Table 3 is at %, and the composition is shown with the entire alloy 100 at %. Hereinafter, each RFeB-based alloy will be called "alloy A", "alloy B", etc. using the characters A through B shown in Table 3.

These alloys A through D were manufactured in the following manner. Every alloy was manufactured by weighing raw materials on the market to have a desired composition, melting them using a high frequency melting furnace, and casting a molten material, thereby preparing an ingot of 100 kg. This alloy ingot was heated at 1413 K for 40 hours in an Ar gas atmosphere to homogenize the structure thereof (homogenizing heat treatment). This alloy ingot was further pulverized using a jaw crusher into large grains having an average particle diameter of not more than 10 mm to obtain alloys A through D having different compositions. The alloy D was pulverized into large grains without being subjected to the homogenizing heat treatment after the melting and casting treatments.

Next, as shown in Tables 1 and 2, many test pieces were manufactured by varying the kind of the alloy, and the manufacturing process. The treating amount of each test piece was determined to 12.5 g. The alloy to be used in each test was placed in a treatment furnace, and subjected to the low-temperature hydrogenation process in the common condition of room temperature, 100 kPa, and 1 hour. Then, the alloy was subjected to the high-temperature hydrogenation process for 180 minutes. The temperature (T1) and the hydrogen partial pressure (P1) in the high-temperature hydrogenation process of each test piece were shown in Tables 1 and 2.

Only the test piece No. 26 in Table 1 was not subjected to the above-described low-temperature hydrogenation process, but was directly subjected to the high-temperature hydrogenation process after raising the temperature from room temperature to a predetermined temperature under a predetermined hydrogen pressure. And, in the case of the test piece No. 26, a block of about 5 through 10 mm was used as the alloy ingot.

Furthermore, the controlled evacuation process of which the hydrogen partial pressure was 1 kPa was carried out for 90 minutes. The temperature (T3) of this controlled evacuation process of each test piece was shown in Tables 1 and 2. In each of the test pieces No. C1 to C16, the high-temperature hydrogenation process and the controlled evacuation process were carried out at the same temperature, and accordingly, T3 equals T1. At last, the forced evacuation process was carried out for thirty minutes at the same temperature as that of the controlled evacuation process and under the hydrogen partial pressure in the treatment furnace of not more than 1 Pa.

Figure 2:
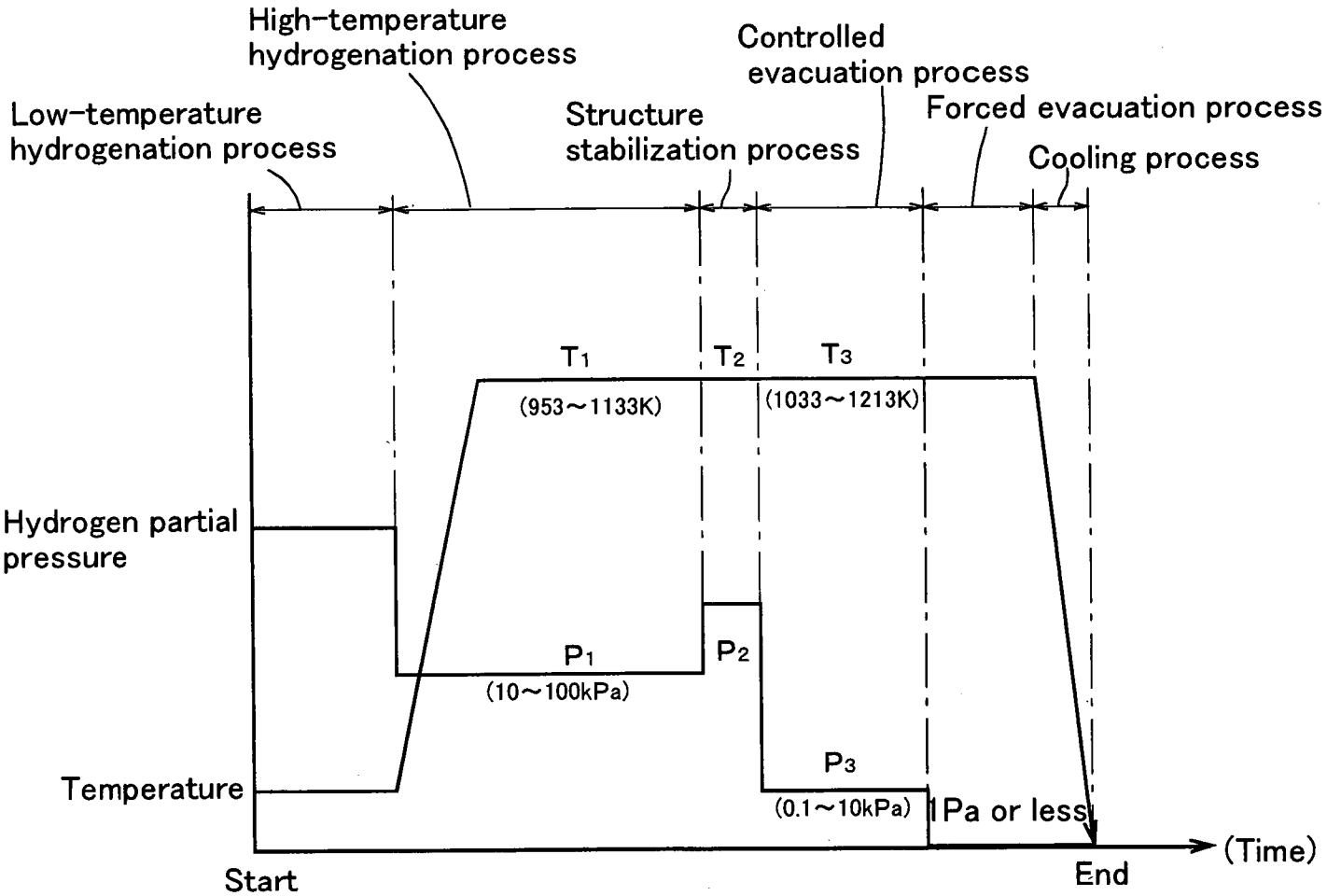
FIG. 2 is a second process pattern diagram which diagrammatically shows details of treatments in each process.
Figure 3:
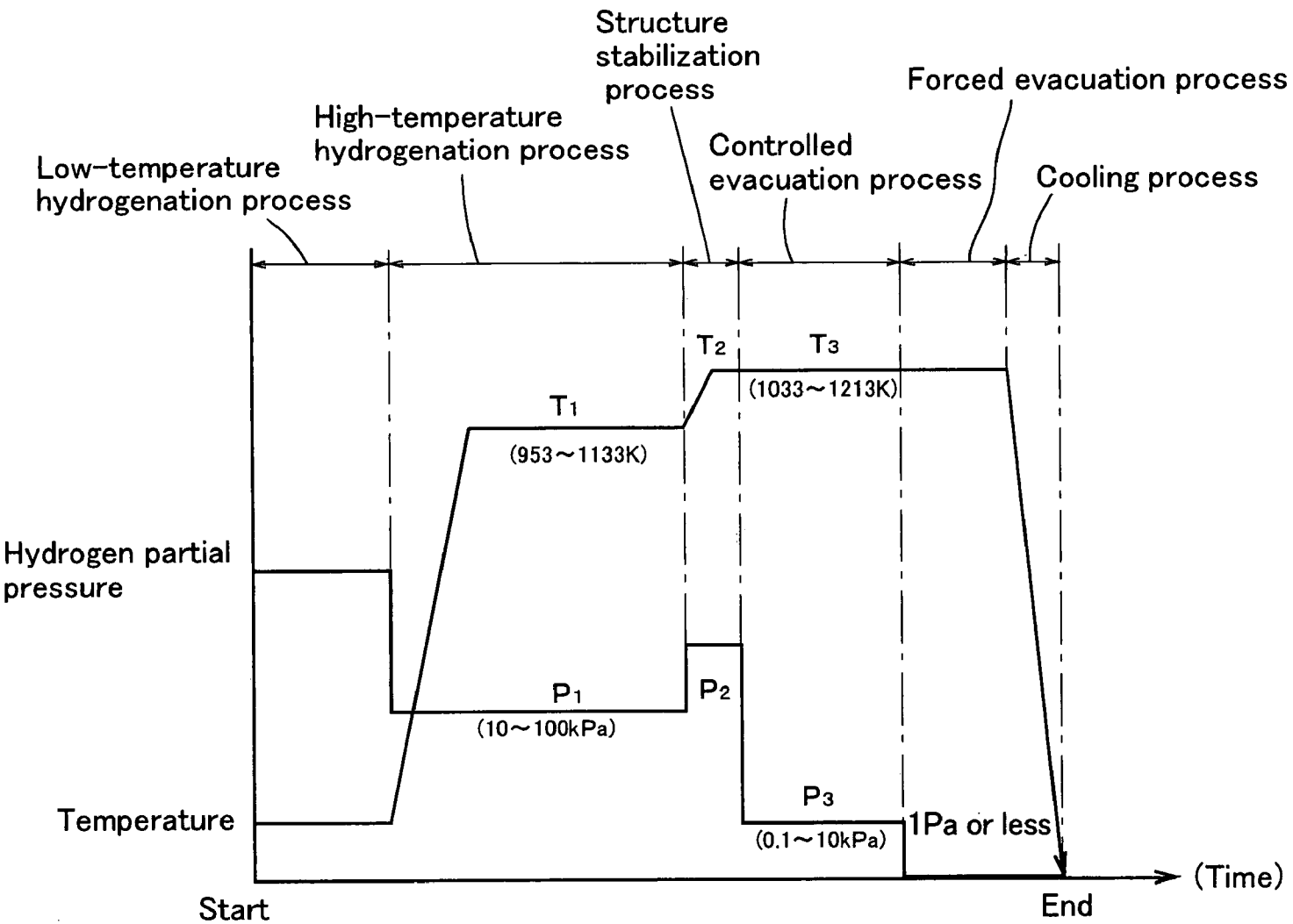
FIG. 3 is a third process pattern diagram which diagrammatically shows details of treatments in each process.

In the case of the test pieces No. 1 thorough 26, the structure stabilization process was provided between the high-temperature hydrogenation process and the controlled evacuation process. In the structure stabilization process, at least one of the treatment temperature and the hydrogen partial pressure was increased. These process patterns are shown in FIGS. 1, 2 and 3. In the structure stabilization process, the temperature was raised from T1 to T2 for five minutes, but the temperature holding time was varied for every test piece. The details are shown in Table 1.

Figure 4:
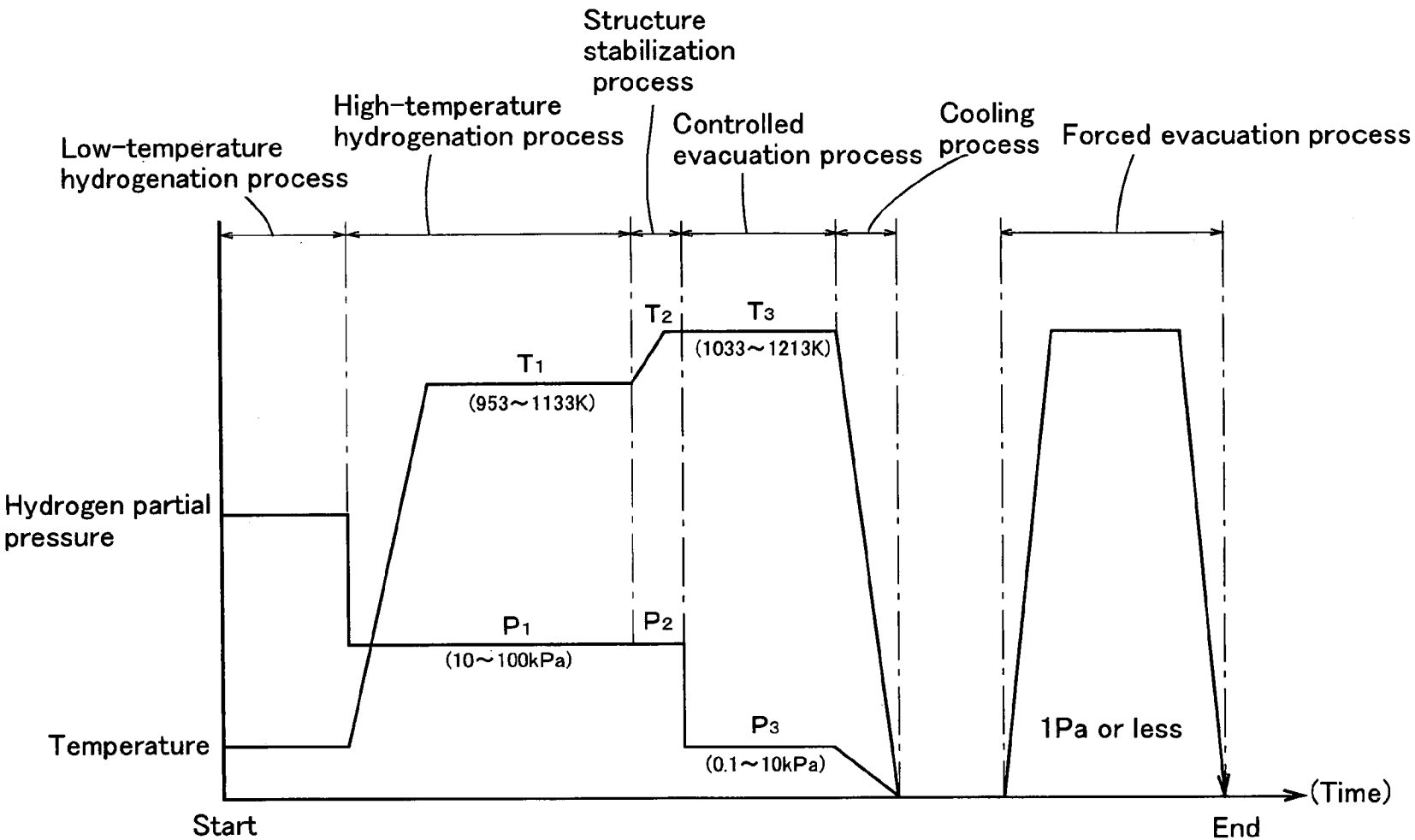
FIG. 4 is a fourth process pattern diagram which diagrammatically shows details of treatments in each process.

Furthermore, in the test pieces No. 19 through 23 out of the test pieces No. 1 through 26, after the controlled evacuation process, a cooling process of transferring hydride of the RFeB-based alloy to a cooling furnace, and cooling the transferred hydride to room temperature was added. And after this cooling process, the above-described forced evacuation process of heating the hydride again and drawing gases therefrom was carried out. The process pattern at this time is shown in FIG. 4.

Figure 5:
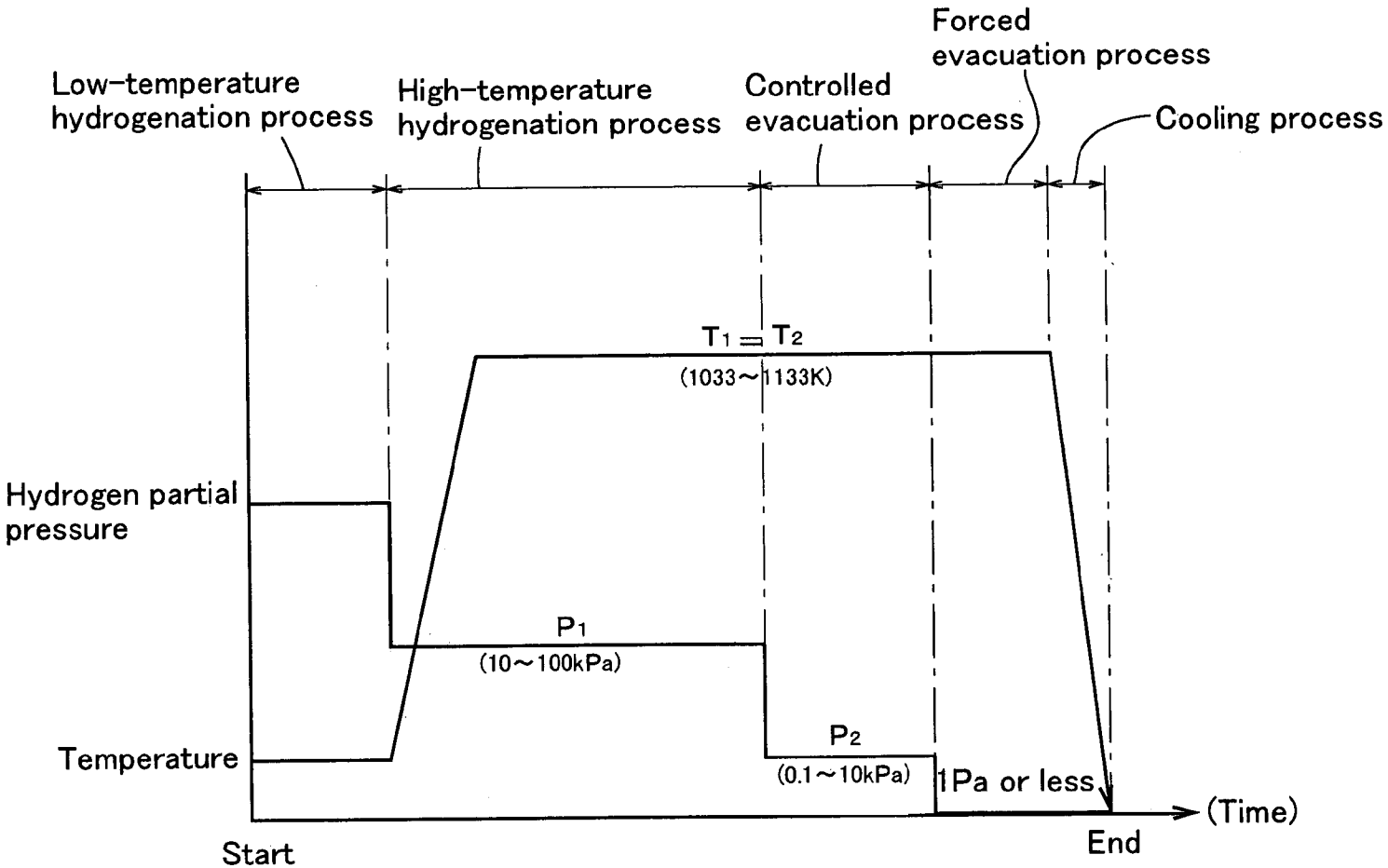
FIG. 5 is a fifth process pattern diagram which diagrammatically shows details of treatments in each process.

In the test pieces No. C1 through C16, the above-described structure stabilization process was not provided, but the controlled evacuation process was carried out directly after the high-temperature hydrogenation process. The process pattern at this time is shown in FIG. 5.

In the test pieces No. C17 through C22, the above-described structure stabilization process was provided, but T1 in the high-temperature hydrogenation process, and T2 and P2 in the structure stabilization process and T3 in the controlled evacuation process were outside the preferred ranges in accordance with the present invention.

Figure 6:
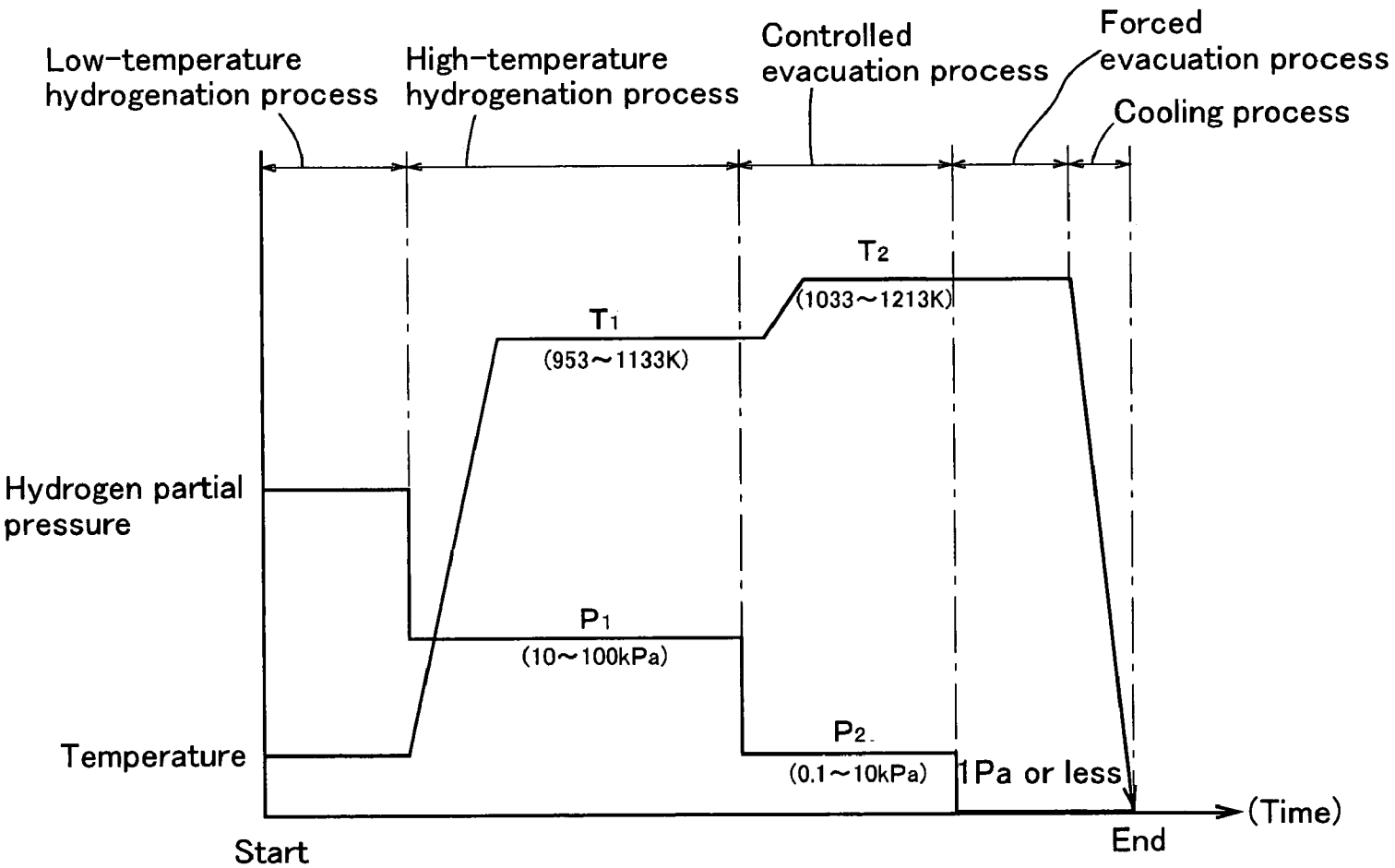
FIG. 6 is a sixth process pattern diagram which diagrammatically shows details of treatments in each process.

The test piece No. C23 was obtained by raising the temperature of the interior of the treatment furnace from T1 to T3 in five minutes when 5 minutes had passed after the start of the controlled evacuation process without being subjected to the structure stabilization process. The test piece No. C24 was obtained by raising the temperature of the interior of the treatment furnace from T1 to T3 in five minutes when 15 minutes had passed after the start of the controlled evacuation process without being subjected to the structure stabilization process. These process patterns are shown in FIG. 6.

(2) Second Example

To examine the effect of the diffusion heat treatment in addition to the d-HDDR treatment, test pieces No. 27 through 47 shown in Table 4 were manufactured. Six kinds of rare earth alloys having different compositions were prepared as raw materials for the diffusion materials of these test pieces. These compositions are shown in Table 5. The unit used in Table 5 is at %, and the composition is shown with the entire alloy 100 at %. Hereinafter, the rare earth alloys will be distinguished from each other using the characters a through f shown in Table 5.

Upon manufacturing the test pieces No. 27 through 47, first, one of the alloys B through D shown in Table 3 was subjected to the above-described low-temperature hydrogenation process, high-temperature hydrogenation process, structure stabilization process and controlled evacuation process, and then cooled to room temperature in the cooling process. As a result, a hydride powder (average particle diameter: 100 μm) of RFeB-based alloy was prepared.

Next, a hydride powder of one of the rare earth alloys a through f was prepared as the diffusion material. The average particle diameters of the hydride powders of the rare earth alloys a through f are different from each other, but were in the range from 5 to 30 μm.

Figure 7:
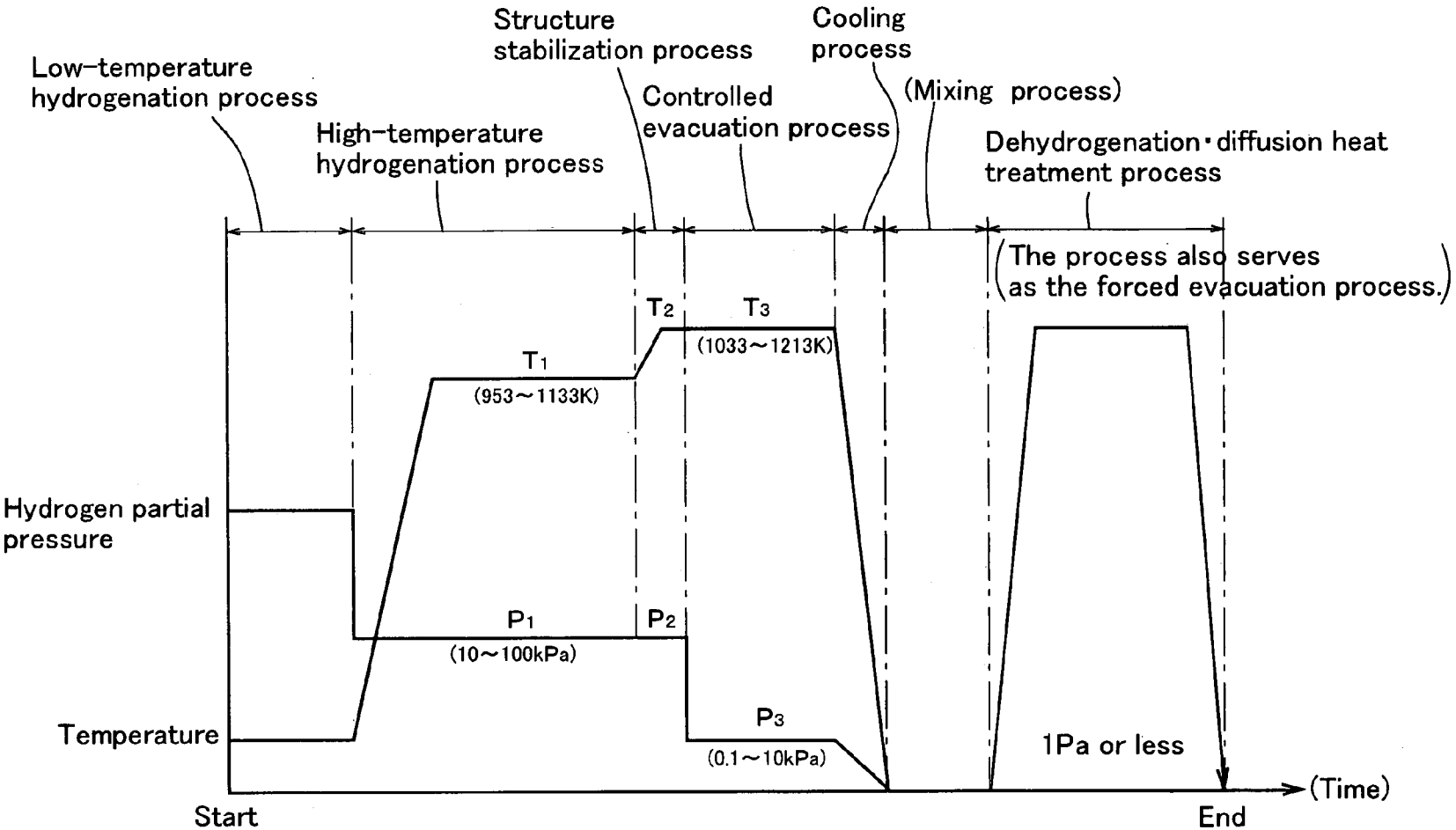
FIG. 7 is a seventh process pattern diagram which diagrammatically shows details of treatments in each process.

Mixture powders, each being obtained by mixing the above-described two kinds of powders with each other (mixing process), were subjected to the diffusion heat treatment process to obtain anisotropic magnet powders of the test pieces No. 27 through 47. The process pattern is shown in FIG. 7.

The test piece No. 44 uses powder of rare earth alloy b (average particle diameter: 5 μm) as the diffusion material in place of the above-described hydride.

Figure 8:
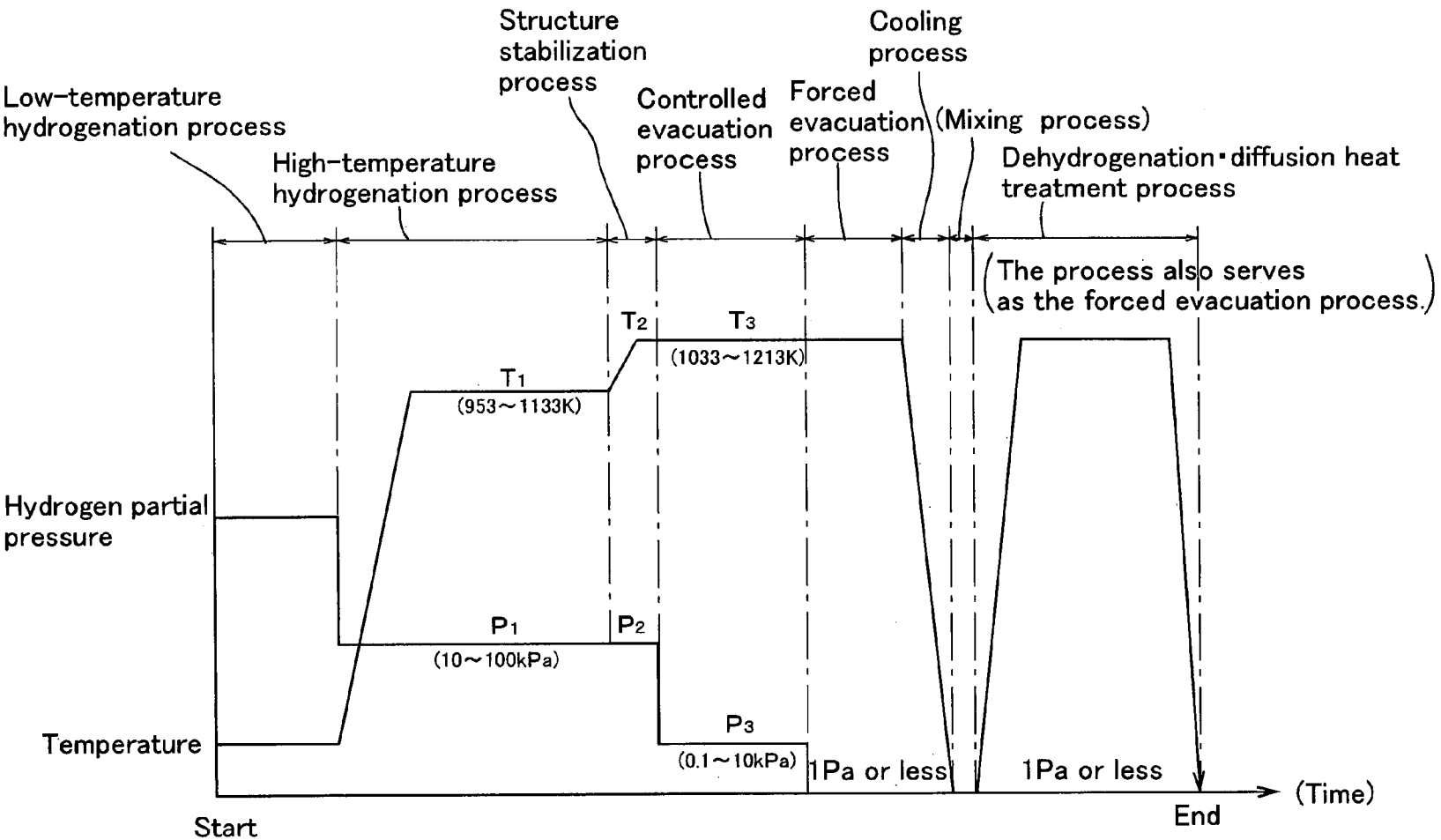
FIG. 8 is an eighth process pattern diagram which diagrammatically shows details of treatments in each process.

The test piece No. 40 used the anisotropic magnet powder which was after the forced evacuation process in place of the hydride powder of the RFeB-based alloy in the controlled evacuation process. Namely, the anisotropic magnet powder which was subjected to the forced evacuation process continuously after the controlled evacuation process without being subjected to the cooling process was used. The process pattern is shown in FIG. 8.

Figure 9:
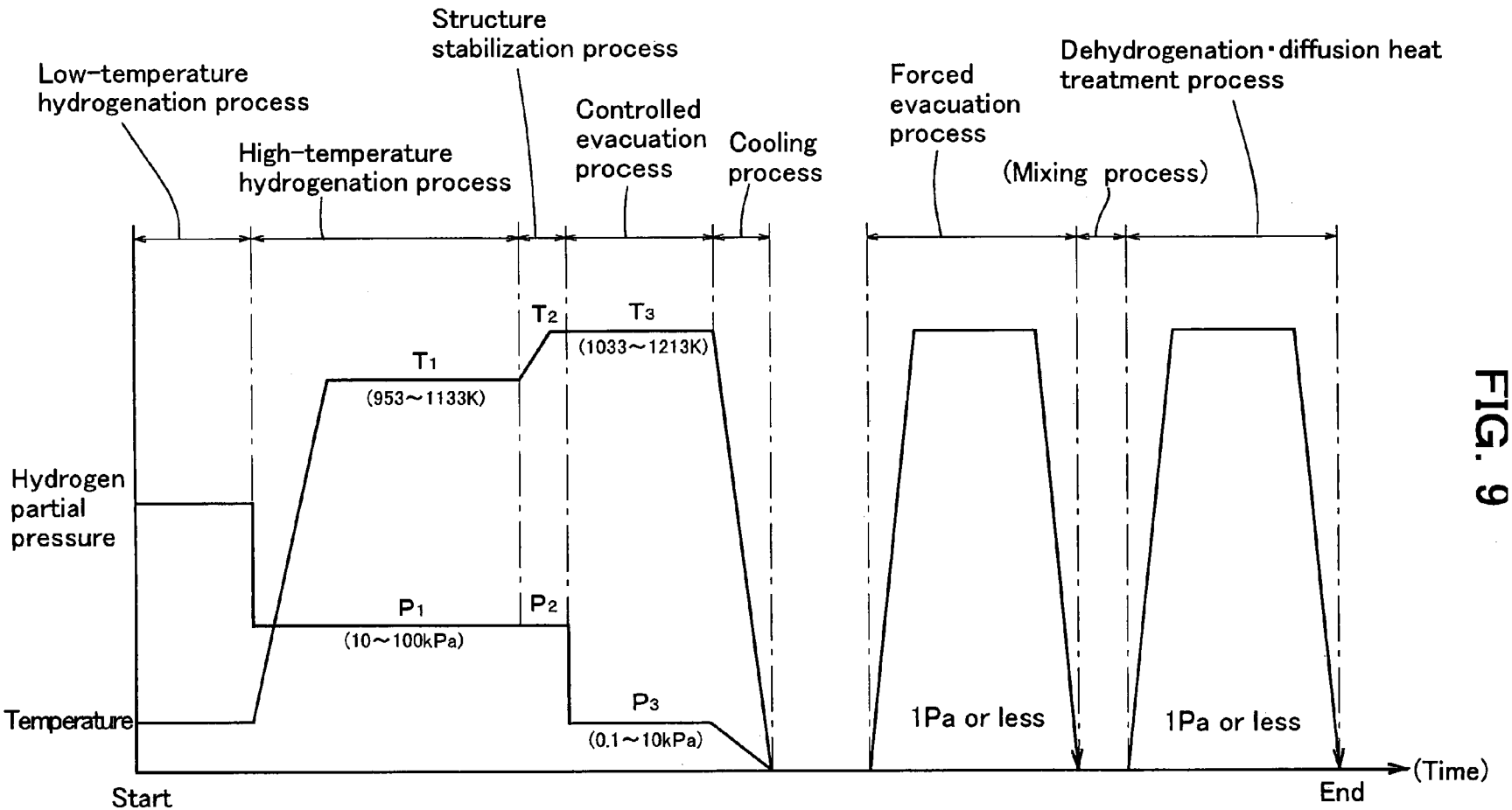
FIG. 9 is a ninth process pattern diagram which diagrammatically shows details of treatments in each process.

The test piece No. 47 used the anisotropic magnet powder which was temporarily cooled after the controlled evacuation process, and was subjected to the forced evacuation process by heating in a vacuum atmosphere. The process pattern is shown in FIG. 9.

The conditions of the d-HDDR treatment and the diffusion heat treatment which were carried out upon manufacturing these test pieces No. 27 through 47 are as follows. Different conditions in these test pieces were respectively shown in Table 4. That is, the treating amount of the RFeB-based alloy: 12.5 g, low-temperature hydrogenation process: room temperature×100 kPa×1 hour, high-temperature hydrogenation process: 1053 K×180 minutes, structure stabilization process: the temperature is raised for five minutes→ the temperature is held for 10 minutes, controlled evacuation process: 1113 K×1 kPa×90 minutes, forced evacuation process: 1113 K×10 Pa or less×30 minutes, dehydrogenation·diffusion heat treatment process: 1073 K×1 Pa or less×1 hour.

(3) Third Example

To examine the effect of the d-HDDR treatment and the diffusion heat treatment on the mass production, test pieces No. 48 through 54, C25 and C26 shown in Table 6 and Table 7 were manufactured. The test pieces No. 48 through 51 and C25 were subjected to only d-HDDR treatment, and the test pieces No. 52 through 54 and C26 were further subjected to the diffusion heat treatment. The RFeB-based alloys used to prepare these test pieces are all alloys B, and the treating amount thereof is 10 kg. And hydride powders of rare earth alloys b were used as the diffusion material. The diffusion material was mixed with the hydride of the RFeB-based alloy after the controlled evacuation process in the amount of 1 to 3 mass % of the entire mixture material. The details of other processes were shown in Table 6 and Table 7 together.

(Measurement of Test Pieces)

The magnetic properties ((BH)max, iHc and Br) of the obtained magnet powders were measured at room temperature. The measurement was carried out using a VSM. The test pieces for measurement were obtained by first, classifying the magnet powders into particle diameters ranging from 75 to 106 μm, and solidifying and forming the classified magnet powders with paraffin so that the demagnetizing factor becomes 0.2. They were oriented in the magnetic field of 1.5 T. and polarized with 4.5 T. Then, the (BH)max, iHc and Br thereof were measured with VSM.

(Evaluation)

(1) With Respect to the d-HDDR Treatment

As is apparent from the comparision between the test pieces No. 1 through 26 and the test pieces No. C1 through C24, in the case of the test pieces No. 1 through 26 in accordance with the present invention, the magnetic properties thereof are improved by subjecting them to the structure stabilization process between the high-temperature hydrogenation process and the controlled evacuation process. For example, in the case of the anisotropic magnet powder composed of the alloy B, of which the maximum energy product ((BH)max) is maximum, the maximum energy product of the test piece No. 4 is improved to 372 (kJ/m$^3$) as compared with that of the conventional test piece No. C7, which is 360 (kJ/m$^3$). In addition, in the case of the anisotropic magnet powder composed of the alloy C, of which the maximum energy product ((BH)max) is maximum, the maximum energy product of the test piece No. 19 is improved to 382 (kJ/m$^3$) as compared with that of the conventional test piece No. C12, which is 360 (kJ/m$^3$). From these results, it is clear that the anisotropic magnet powder manufactured by the method of the present invention is excellent, as compared with the conventional manufacturing method.

The case of the alloy B has been explained, but the anisotropic magnet powders composed of other alloys also have similar tendencies, as compared with the anisotropic magnet powders having the same composition. With respect to the test pieces No. 19 through 23, the cooling process was provided between the controlled evacuation process and the forced evacuation process. It can be also confirmed that with this order of the processes, excellent magnetic properties can be obtained and the mass production is facilitated.

The test results of the test pieces No. C17 through C22 show that even if the structure stabilization process is provided between the high-temperature hydrogenation process and the controlled evacuation process, desired magnetic properties are not effected as long as the temperature and the hydrogen partial pressure are out of the preferable temperature range and the preferable hydrogen partial pressure range.

With respect to the temperature, as is apparent from the comparison between the test pieces No. C23 and C24 and the test piece No. 4, when the temperature is raised in the controlled evacuation process improperly, the magnetic properties were not improved.

As is apparent from the test results of the test pieces No. 11 through 15 or the test pieces No. 19 through 22, by prolonging the holding time in the structure stabilization process, the coercive force (iHc) could be improved. Therefore, by prolonging the holding time, the heat resistance of the anisotropic magnet powder can be enhanced. The comparison between the test results of the test pieces No. 11 through 15 and those of the test pieces No. 19 through 22 showed that this tendency was observed regardless of the provision of the cooling process between the controlled evacuation process and the forced evacuation process.

It has become apparent from the test results of the test pieces No. 17 and 18 that by raising the hydrogen partial pressure (P2) in the structure stabilization process, the magnetic properties are improved, as compared with C5 manufactured with the conventional d-HDDR process. But, it has already become clear from the present inventor's studies that the improvement of the magnetic properties tends to be saturated when P2 is increased over a certain degree. It is preferable that the upper limit of P2 in the structure stabilization step is 200 k kPa considering the cost and durability of the treatment furnace upon mass production.

The test piece No. 24 is the embodiment showing that the conditions of T2>T1 and P2<P1 will do. As shown in the present embodiment, even where P2 is 20 kPa in the case of P1 being 30 kPa, the object of the structure stabilization process is sufficiently achieved by raising T2 from 1053K as T1 to 1133 K to cancel the influence of P2<P1 sufficiently. The test piece No. 25 is the embodiment showing that the conditions of T2<T1 and P2>P1 will do. As shown in the present embodiment, even where T2 is 1103 K in the case of T1 being 1113 K, the object of the structure stabilization process is sufficiently achieved by raising P2 from 30 kPa as P1 to 200 kPa to cancel the influence of T2<T1 sufficiently. As a result, good magnetic properties are effected by both the test pieces No. 24 and 25.

Test pieces No. 26 and C5 are equal to each other in the composition of alloys and the condition of the high-temperature hydrogenation process, but are different from each other in that the low-temperature hydrogenation process and the structure stabilization process are provided or not. It has been clarified from the comparison between these test pieces that the magnetic properties such as (BH)max and iHc can be enhanced by providing the structure stabilization process without providing the low-temperature hydrogenation process.

(2) With Respect to the Diffusion Heat Treatment

It has been apparent from the comparison between the test pieces No. 27 through 47 and the test pieces No. 1 through 26, that iHc is increased due to the diffusion heat treatment in all cases. This is important for giving the heat resistance to magnets. And, It has been apparent from the comparison between the test pieces No. 33, etc. and the test pieces No. 41 through 43, that the preferable composition ratio of the diffusion material ranges from about 0.5 to 1 mass %, and that in the case of exceeding 1 mass %, the magnetic properties were lowered. In addition, it has been apparent from the comparison between the test piece No. 33 and the test piece No. 44, that the diffusion material other than hydride sufficiently exhibits such effect.

It has been apparent from the test results of the test pieces No. 27 through 29, iHc can be enhanced by prolonging the holding time in the structure stabilization process even where the diffusion heat treatment is carried out. Accordingly, in this case, the heat resistance of the anisotropic magnet powder can be enhanced by prolonging the holding time in the structure stabilization process. Of course, as is apparent from the test results of the test pieces No. 29 through 32, by increasing the composition ratio of the diffusion material, iHc is improved, and the heat resistance of the anisotropic magnet powder can be enhanced.

(3) With Respect to the Mass Production Properties

The test pieces No. 48 through 51 intend to mass-produce the test piece No. 4, and the test piece No. C25 intends to mass-produce the test piece No. C7. In these cases, the magnetic properties tend to slightly lower with the increment of the treating amount, but, in the test pieces No. 46 through 49, such tendency was smaller than that of the test piece No. C25. More specifically, as compared with the test piece No. C7, (BH)max of the test piece No. C25 lowers by 42 (kJ/m$^3$), whereas, as compared with the test piece No. 4, (BH)max of the test piece No. 48 lowers by merely 20 (kJ/m$^3$). As described above, with the manufacturing method in accordance with the present invention, the lowering of the magnetic properties upon mass production was not more than one half of that of the conventional manufacturing method. Accordingly, the manufacturing method of the present invention is a very effective method from the industrial viewpoint, and anisotropic magnet powder with high magnetic properties can be obtained not only on the levels of testing rooms but also upon mass production.

As is apparent from the test results of the test pieces No. 48 through 51, if the treating amount is increased, by prolonging the holding time in the structure stabilization process, iHc is improved, whereby the heat resistance of the anisotropic magnet powder is enhanced.

It has been also found that by subjecting the test pieces No. 52 through 54 and the test piece No. C26, which have been subjected to the diffusion heat treatment, to the structure stabilization process, the anisotropic magnet powder with high magnetic properties can be obtained even upon mass production thereof, and that by increasing the composition ratio of the diffusion material, iHc increases, thereby enhancing the heat resistance of the anisotropic magnet powder.

TABLE 1

| | | High-temperature hydrogenation process | | Structure stabilization process | | | Controlled evacuation process | | | | | |
|---|---|---|---|---|---|---|---|---|---|---|---|---|
| Test pieces No. | RFeB-based alloys | Treatment temperature T1 (K) | Hydrogen partial pressure P1 (kPa) | Treatment temperature T2 (K) | Temperature holding time (minutes) | Hydrogen partial pressure P2 (kPa) | Temperature T3 (K) | Hydrogen partial pressure P3 (kPa) | (BH)max (kJ/m3) | iHc (MA/m) | Br (T) | Remarks |
| 1 | A | 1053 | 20 | 1113 | 10 | 20 | 1113 | 1 | 276 | 0.53 | 1.36 | With low- |
| 2 | B | 1053 | 30 | 1073 | 10 | 30 | 1073 | 1 | 339 | 0.83 | 1.41 | temperature |
| 3 | B | 1053 | 30 | 1093 | 10 | 30 | 1093 | 1 | 360 | 1.00 | 1.43 | hydrogenation |
| 4 | B | 1053 | 30 | 1113 | 10 | 30 | 1113 | 1 | 372 | 1.11 | 1.41 | process |
| 5 | B | 1053 | 30 | 1133 | 10 | 30 | 1133 | 1 | 368 | 1.15 | 1.40 | |
| 6 | B | 1053 | 30 | 1153 | 10 | 30 | 1153 | 1 | 358 | 1.17 | 1.37 | |
| 7 | B | 1013 | 30 | 1113 | 10 | 30 | 1113 | 1 | 348 | 1.10 | 1.36 | |
| 8 | B | 1033 | 30 | 1113 | 10 | 30 | 1113 | 1 | 366 | 1.09 | 1.40 | |
| 9 | B | 1053 | 30 | 1113 | 10 | 30 | 1113 | 1 | 372 | 1.09 | 1.41 | |
| 10 | B | 1073 | 30 | 1113 | 10 | 30 | 1113 | 1 | 368 | 1.09 | 1.39 | |
| 11 | B | 1053 | 30 | 1113 | 15 | 30 | 1113 | 1 | 369 | 1.12 | 1.40 | |
| 12 | B | 1053 | 30 | 1113 | 30 | 30 | 1113 | 1 | 370 | 1.14 | 1.39 | |
| 13 | B | 1053 | 30 | 1113 | 60 | 30 | 1113 | 1 | 359 | 1.36 | 1.37 | |
| 14 | B | 1053 | 30 | 1113 | 90 | 30 | 1113 | 1 | 354 | 1.39 | 1.36 | |

TABLE 1-continued

| Test pieces No. | RFeB-based alloys | High-temperature hydrogenation process: Treatment temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) | (BH)max (kJ/m3) | iHc (MA/m) | Br (T) | Remarks |
|---|---|---|---|---|---|---|---|---|---|---|---|---|
| 15 | B | 1053 | 30 | 1113 | 150 | 30 | 1113 | 1 | 344 | 1.40 | 1.34 | |
| 16 | B | 1053 | 30 | 1113 | 10 | 30 | 1103 | 1 | 370 | 1.10 | 1.40 | |
| 17 | B | 1053 | 30 | 1053 | 10 | 200 | 1053 | 1 | 365 | 1.13 | 1.39 | |
| 18 | B | 1053 | 30 | 1113 | 10 | 200 | 1103 | 1 | 364 | 1.13 | 1.39 | |
| 19 | C | 1053 | 40 | 1113 | 10 | 40 | 1113 | 1 | 382 | 1.08 | 1.41 | |
| 20 | C | 1053 | 40 | 1113 | 30 | 40 | 1113 | 1 | 362 | 1.20 | 1.38 | |
| 21 | C | 1053 | 40 | 1113 | 90 | 40 | 1113 | 1 | 332 | 1.36 | 1.32 | |
| 22 | C | 1053 | 40 | 1113 | 150 | 40 | 1113 | 1 | 305 | 1.46 | 1.26 | |
| 23 | D | 1053 | 40 | 1113 | 10 | 40 | 1113 | 1 | 304 | 1.14 | 1.27 | |
| 24 | B | 1053 | 30 | 1133 | 10 | 20 | 1113 | 1 | 372 | 1.09 | 1.40 | |
| 25 | B | 1113 | 30 | 1103 | 10 | 200 | 1103 | 1 | 361 | 1.08 | 1.39 | |
| 26 | B | 1053 | 30 | 1113 | 10 | 30 | 1113 | 1 | 362 | 1.06 | 1.40 | Without low-temperature hydrogenation process |

TABLE 2

| Test pieces No. | RFeB-based alloys | High-temperature hydrogenation process: Temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) | (BH)max (kJ/m3) | iHc (MA/m) | Br (T) | Remarks |
|---|---|---|---|---|---|---|---|---|---|---|---|---|
| C1 | A | 1053 | 20 | — | — | — | T1 = T2 = T3 | 1 | 10 | 0.03 | 0.82 | Conventional |
| C2 | A | 1093 | 20 | — | — | — | T1 = T2 = T3 | 1 | 262 | 0.53 | 1.34 | d-HDDR |
| C3 | A | 1113 | 20 | — | — | — | T1 = T2 = T3 | 1 | 224 | 0.48 | 1.30 | treatment |
| C4 | B | 1033 | 30 | — | — | — | T1 = T2 = T3 | 1 | 13 | 0.03 | 0.96 | without |
| C5 | B | 1053 | 30 | — | — | — | T1 = T2 = T3 | 1 | 294 | 0.70 | 1.42 | structure |
| C6 | B | 1073 | 30 | — | — | — | T1 = T2 = T3 | 1 | 343 | 0.95 | 1.41 | stabilization |
| C7 | B | 1093 | 30 | — | — | — | T1 = T2 = T3 | 1 | 360 | 1.16 | 1.39 | process |
| C8 | B | 1113 | 30 | — | — | — | T1 = T2 = T3 | 1 | 318 | 1.19 | 1.35 | |
| C9 | B | 1133 | 30 | — | — | — | T1 = T2 = T3 | 1 | 129 | 0.89 | 1.30 | |
| C10 | B | 1153 | 30 | — | — | — | T1 = T2 = T3 | 1 | 40 | 0.40 | 1.22 | |
| C11 | C | 1053 | 40 | — | — | — | T1 = T2 = T3 | 1 | 326 | 0.70 | 1.41 | |
| C12 | C | 1093 | 40 | — | — | — | T1 = T2 = T3 | 1 | 360 | 1.17 | 1.39 | |
| C13 | C | 1113 | 40 | — | — | — | T1 = T2 = T3 | 1 | 328 | 1.19 | 1.36 | |
| C14 | D | 1033 | 40 | — | — | — | T1 = T2 = T3 | 1 | 6 | 0.05 | 0.40 | |
| C15 | D | 1073 | 40 | — | — | — | T1 = T2 = T3 | 1 | 290 | 1.14 | 1.25 | |
| C16 | D | 1093 | 40 | — | — | — | T1 = T2 = T3 | 1 | 216 | 1.19 | 1.09 | |
| C17 | B | 933 | 30 | 1113 | 10 | 30 | 1113 | 1 | 18 | 0.05 | 0.96 | T1: below preferred ranges |
| C18 | B | 1153 | 30 | 1193 | 10 | 30 | 1193 | 1 | 40 | 0.16 | 1.24 | T1: above preferred ranges |
| C19 | B | 993 | 30 | 1013 | 10 | 30 | 1013 | 1 | 9 | 0.02 | 0.80 | T2&T3: below preferred ranges |
| C20 | B | 1053 | 30 | 1233 | 10 | 30 | 1233 | 1 | 272 | 1.08 | 1.25 | T2&T3: above preferred ranges |
| C21 | B | 1113 | 30 | 1053 | 10 | 30 | 1053 | 1 | 94 | 0.23 | 1.21 | T1 > T2, T3: outside preferred ranges |
| C22 | B | 1053 | 30 | 1053 | 10 | 5 | 1053 | 1 | 105 | 0.29 | 1.25 | P2: below preferred hydrogen partial pressure ranges |

TABLE 2-continued

| Test pieces No. | RFeB-based alloys | High-temperature hydrogenation process: Temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) | (BH)max (kJ/m3) | iHc (MA/m) | Br (T) | Remarks |
|---|---|---|---|---|---|---|---|---|---|---|---|---|
| C23 | B | 1053 | 30 | — | — | — | 1053→1113 | 1 | 305 | 0.72 | 1.40 | After 5 minutes of controlled evacuation process, raising temperature to 1113 K in 5 minutes |
| C24 | B | 1053 | 30 | — | — | — | 1053→1113 | 1 | 304 | 0.64 | 1.40 | After 15 minutes of controlled evacuation process, raising temperature to 1113 K in 5 minutes |

TABLE 3

| RFeB-based alloys | Alloy composition (at %): Nd | B | Co | Ga | Nb | Fe |
|---|---|---|---|---|---|---|
| A | 12.5 | 6.4 | — | — | — | bal. |
| B | 12.5 | 6.4 | — | 0.3 | 0.2 | bal. |
| C | 12.5 | 6.4 | 5.0 | 0.3 | 0.2 | bal. |
| D | 12.5 | 11.5 | 5.0 | 0.3 | 0.2 | bal. |

TABLE 4

| Test pieces No. | RFeB-based alloys | High-temperature hydrogenation process: Temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) |
|---|---|---|---|---|---|---|---|---|
| 27 | B | 1053 | 30 | 1113 | 10 | 30 | 1113 | 1 |
| 28 | B | 1053 | 30 | 1113 | 30 | 30 | 1113 | 1 |
| 29 | B | 1053 | 30 | 1113 | 90 | 30 | 1113 | 1 |
| 30 | B | 1053 | 30 | 1113 | 90 | 30 | 1113 | 1 |
| 31 | B | 1053 | 30 | 1113 | 90 | 30 | 1113 | 1 |
| 32 | B | 1053 | 30 | 1113 | 90 | 30 | 1113 | 1 |
| 33 | B | 1053 | 30 | 1113 | 10 | 30 | 1113 | 1 |
| 34 | C | 1053 | 40 | 1113 | 10 | 40 | 1113 | 1 |
| 35 | B | 1053 | 30 | 1113 | 10 | 30 | 1113 | 1 |
| 36 | D | 1053 | 40 | 1113 | 10 | 40 | 1113 | 1 |
| 37 | B | 1053 | 30 | 1113 | 10 | 30 | 1113 | 1 |
| 38 | B | 1053 | 30 | 1113 | 10 | 30 | 1113 | 1 |
| 39 | B | 1053 | 30 | 1113 | 10 | 30 | 1113 | 1 |
| 40 | B | 1053 | 30 | 1113 | 10 | 30 | 1113 | 1 |
| 41 | B | 1053 | 30 | 1113 | 10 | 30 | 1113 | 1 |
| 42 | B | 1053 | 30 | 1113 | 10 | 30 | 1113 | 1 |
| 43 | B | 1053 | 30 | 1113 | 10 | 30 | 1113 | 1 |
| 44 | B | 1053 | 30 | 1113 | 10 | 30 | 1113 | 1 |

TABLE 4-continued

| | | | | | | | | |
|---|---|---|---|---|---|---|---|---|
| 45 | B | 1053 | 30 | 1053 | 10 | 50 | 1053 | 1 |
| 46 | B | 1053 | 30 | 1113 | 10 | 50 | 1103 | 1 |
| 47 | B | 1053 | 30 | 1113 | 10 | 30 | 1113 | 1 |

| Test pieces No. | Last process of RFeB-based alloys before diffusion heat treatment | Diffusion material: Rare earth alloys | Diffusion material: Powdery state | Diffusion material: Powder weight (mass %) | (BH)max (kJ/m3) | iHc (MA/m) | Br (T) |
|---|---|---|---|---|---|---|---|
| 27 | Controlled evacuation process | a | Hydride of TM | 0.5 | 374 | 1.22 | 1.41 |
| 28 | Controlled evacuation process | a | Hydride of TM | 0.5 | 376 | 1.25 | 1.41 |
| 29 | Controlled evacuation process | a | Hydride of TM | 0.5 | 357 | 1.50 | 1.36 |
| 30 | Controlled evacuation process | a | Hydride of TM | 1.5 | 345 | 1.58 | 1.30 |
| 31 | Controlled evacuation process | a | Hydride of TM | 3 | 321 | 1.64 | 1.29 |
| 32 | Controlled evacuation process | a | Hydride of TM | 5 | 310 | 1.68 | 1.26 |
| 33 | Controlled evacuation process | b | Hydride of TM | 0.5 | 373 | 1.18 | 1.41 |
| 34 | Controlled evacuation process | b | Hydride of TM | 0.5 | 384 | 1.15 | 1.42 |
| 35 | Controlled evacuation process | c | Hydride of TM | 0.5 | 372 | 1.19 | 1.40 |
| 36 | Controlled evacuation process | d | Hydride of TM | 1.4 | 288 | 1.26 | 1.24 |
| 37 | Controlled evacuation process | e | Hydride of TM | 0.5 | 374 | 1.12 | 1.41 |
| 38 | Controlled evacuation process | f | Hydride of TM | 0.5 | 377 | 1.26 | 1.41 |
| 39 | Controlled evacuation process | g | Hydride of TM | 0.5 | 371 | 1.12 | 1.41 |
| 40 | Forced evacuation process | b | Hydride of TM | 1 | 351 | 1.26 | 1.36 |
| 41 | Controlled evacuation process | b | Hydride of TM | 1 | 349 | 1.26 | 1.35 |
| 42 | Controlled evacuation process | b | Hydride of TM | 2 | 321 | 1.34 | 1.31 |
| 43 | Controlled evacuation process | b | Hydride of TM | 5 | 267 | 1.33 | 1.18 |
| 44 | Controlled evacuation process | b | Alloy | 0.5 | 355 | 1.18 | 1.41 |
| 45 | Controlled evacuation process | b | Hydride of TM | 1 | 343 | 1.26 | 1.34 |
| 46 | Controlled evacuation process | b | Hydride of TM | 1 | 342 | 1.26 | 1.34 |
| 47 | Forced evacuation process (Controlled evacuation process →Cooling process →Forced evacuation process) | b | Hydride of TM | 1 | 350 | 1.25 | 1.36 |

TABLE 5

| Rare earth elements | Alloy composition (at %): Dy | Nd | Tb | Pr | La | Fe | Ni | Co |
|---|---|---|---|---|---|---|---|---|
| a | 58 | — | — | — | — | 42 | — | — |
| b | 77 | — | — | — | — | — | 23 | — |
| c | 50 | — | — | — | 30 | — | — | 29 |
| d | — | 77 | — | — | — | — | — | 23 |
| e | — | — | 77 | — | — | — | — | 23 |
| f | — | — | — | 77 | — | — | — | 23 |

TABLE 6

| Test pieces No. | RFeB-based alloys | High-temperature hydrogenation process: Temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) | (BH)max (kJ/m3) | iHc (MA/m) | Br (T) |
|---|---|---|---|---|---|---|---|---|---|---|---|
| 48 | B | 1053 | 32 | 1113 | 30 | 32 | 1113 | 1.1 | 352 | 1.14 | 1.39 |
| 49 | B | 1083 | 32 | 1133 | 50 | 32 | 1113 | 1.1 | 354 | 1.17 | 1.38 |
| 50 | B | 1083 | 32 | 1133 | 100 | 32 | 1113 | 1.1 | 345 | 1.23 | 1.36 |
| 51 | B | 1083 | 32 | 1133 | 150 | 32 | 1113 | 1.1 | 340 | 1.24 | 1.35 |
| C25 | B | 1093 | 32 | None | None | None | T2 = T1 | 1.1 | 318 | 1.04 | 1.35 |

TABLE 7

| Test pieces No. | RFeB-based alloys | High-temperature hydrogenation process: Temperature T1 (K) | High-temperature hydrogenation process: Hydrogen partial pressure P1 (kPa) | Structure stabilization process: Treatment temperature T2 (K) | Structure stabilization process: Temperature holding time (minutes) | Structure stabilization process: Hydrogen partial pressure P2 (kPa) | Controlled evacuation process: Temperature T3 (K) | Controlled evacuation process: Hydrogen partial pressure P3 (kPa) |
|---|---|---|---|---|---|---|---|---|
| 52 | B | 1053 | 32 | 1113 | 30 | 32 | 1113 | 1.1 |
| 53 | B | 1083 | 32 | 1113 | 30 | 32 | 1113 | 1.1 |
| 54 | B | 1083 | 32 | 1113 | 30 | 32 | 1113 | 1.1 |
| C26 | B | 1093 | 32 | None | None | None | T2 = T1 | 1.1 |

| Test pieces No. | Last process of RFeB-based alloys before diffusion heat treatment | Diffusion material: Rare earth alloys | Diffusion material: Powdery state | Diffusion material: Powder weight (mass %) | (BH)max (kJ/m3) | iHc (MA/m) | Br (T) |
|---|---|---|---|---|---|---|---|
| 52 | Controlled evacuation process | b | Hydride of TM | 1 | 350 | 1.22 | 1.38 |
| 53 | Controlled evacuation process | b | Hydride of TM | 1.5 | 336 | 1.37 | 1.34 |
| 54 | Controlled evacuation process | b | Hydride of TM | 3 | 320 | 1.54 | 1.30 |
| C26 | Controlled evacuation process | b | Hydride of TM | 1 | 318 | 1.11 | 1.34 |

The invention claimed is:

1. A method for manufacturing an anisotropic magnet powder characterized in that the method comprises:

a high-temperature hydrogenation process of holding an RFeB-based alloy containing a rare earth element (hereinafter referred to as "R"), boron (B) and iron (Fe) as main ingredients in a treating atmosphere under a first treating pressure (hereinafter referred to as "P1") of which a hydrogen partial pressure ranges from 10 to 100 kPa and at a first treating temperature (hereinafter referred to as "T1") which ranges from 953 to 1133 K;

a structure stabilization process of holding said RFeB-based alloy after said high-temperature hydrogenation process in a treating atmosphere under a second treating pressure (hereinafter referred to as "P2") of which a hydrogen partial pressure is 10 kPa or more and at a second treating temperature (hereinafter referred to as "T2") which ranges from 1033 to 1213 K such that one of condition T2>T1 and P2>P1 is satisfied;

a controlled evacuation process of holding said RFeB-based alloy after said structure stabilization process in a treating atmosphere and carrying out dehydrogenation under a third treating pressure (hereinafter referred to as "P3") of which a hydrogen partial pressure ranges from 0.1 to 10 kPa and at a third treating temperature (hereinafter referred to as "T3") which ranges from 1033 to 1213 K such that the condition P3<P2 is satisfied, and a forced evacuation process of removing residual hydrogen (H) from said RFeB-based alloy after said controlled evacuation process.

2. The method for manufacturing an anisotropic magnet powder as claimed in claim 1, wherein said structure stabilization process is a process satisfying one of conditions of P2≧P1, T2>T1 and P2>P1, T2≧T1.

3. The method for manufacturing an anisotropic magnet powder as claimed in claim 1, wherein said structure stabilization process is a process in which the upper limit of said P2 is 200 kPa.

4. The method for manufacturing an anisotropic magnet powder as claimed in claim 1, further comprising a cooling process of cooling said RFeB-based alloy after said controlled evacuation process and before said forced evacuation process.

5. The method for manufacturing an anisotropic magnet powder as claimed in claim 1, further comprising a low-temperature hydrogenation process of holding said RFeB-based alloy in a hydrogen atmosphere of which the temperature is not more than 873 K before said high-temperature hydrogenation process.

6. The method for manufacturing an anisotropic magnet powder as claimed in claim 1, further comprising a mixing process of mixing a diffusion material containing at least one kind of elements (hereinafter referred to as "R1") consisting of dysprosium (Dy), terbium (Tb), neodymium (Nd), praseodymium (Pr), and lanthanum (La) into said RFeB-based alloy which is obtained after one of said controlled evacuation process and said forced evacuation process, thereby obtaining a mixture powder, and a diffusion heat treatment process of heating said mixture powder, thereby diffusing said R1 on a surface and into an inside of said RFeB-based alloy.

7. The method for manufacturing an anisotropic magnet powder as claimed in claim 6, further comprising a dehydrogenation process of removing hydrogen from said mixture powder before said diffusion heat treatment process where hydrogen residues in said mixture powder after said mixing process.

* * * * *